US009384914B2

(12) United States Patent
Kawamura

(10) Patent No.: US 9,384,914 B2
(45) Date of Patent: Jul. 5, 2016

(54) ELECTRONIC COMPONENT ASSEMBLY STRUCTURE AND ELECTRICAL JUNCTION BOX

(71) Applicant: Yazaki Corporation, Tokyo (JP)

(72) Inventor: Yukihiro Kawamura, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/847,166

(22) Filed: Sep. 8, 2015

(65) Prior Publication Data

US 2015/0380181 A1 Dec. 31, 2015

Related U.S. Application Data

(63) Continuation of application No. PCT/JP2014/056708, filed on Mar. 13, 2014.

(30) Foreign Application Priority Data

Mar. 15, 2013 (JP) ..... 2013-053063

(51) Int. Cl.
*H01H 9/20* (2006.01)
*H01R 9/24* (2006.01)

(52) U.S. Cl.
CPC ..... *H01H 9/20* (2013.01); *H01R 9/2458* (2013.01); *H01H 2223/00* (2013.01)

(58) Field of Classification Search
CPC ..... H01H 9/20; H01H 45/14; H01H 9/02; H01H 2009/0285; H01H 45/02; H01R 13/684; H01R 13/68
See application file for complete search history.

(56) References Cited

U.S. PATENT DOCUMENTS

2013/0043971 A1 2/2013 Chen et al.

FOREIGN PATENT DOCUMENTS

JP 63-146939 U 9/1988
JP 2010-016943 A 1/2010
JP 2010-221787 A 10/2010

OTHER PUBLICATIONS

International Search Report of PCT/JP2014/056708 dated Jun. 10, 2014 [PCT/ISA/210].

*Primary Examiner* — Ross Gushi
(74) *Attorney, Agent, or Firm* — Sughrue Mion, PLLC

(57) ABSTRACT

An electronic component includes a main body section having a rectangular parallelepiped shape and a plurality of terminal portions having different rigidities. A housing member includes a first housing chamber that guides and receives the main body section therein and a second housing chamber that receives and holds terminal fittings therein, the first housing chamber is formed by surrounding four sides thereof with a frame-like wall portion rising upright from a bottom portion, and the second housing chamber is formed outside the wall portion. Each terminal portion includes a base end and a fitting portion that extends from a protruding tip of the base end along a side surface of the main body section with a gap from the side surface and that is fitted to the corresponding terminal fitting.

6 Claims, 15 Drawing Sheets

ELECTRONIC COMPONENT ASSEMBLY STRUCTURE AND ELECTRICAL JUNCTION BOX

CROSS-REFERENCE TO RELATED APPLICATION

This application is a continuation application of International Application PCT/JP2014/056708, filed on Mar. 13, 2014, and designating the U.S., the entire contents of which are incorporated herein by reference.

BACKGROUND OF THE INVENTION

1. Field of the Invention

The present invention relates to an electronic component assembly structure in which an electronic component, terminal fittings of electrical wires, and a housing member receiving the electronic component and the terminal fittings therein are mutually assembled, and an electrical junction box having the assembly structure.

2. Description of the Related Art

In general, a vehicle such as an automobile is equipped with an electronic component module in which various electronic components are assembled. Japanese Patent Application Laid-open No. 2010-221787 discloses a configuration of an electrical junction box (junction box) including a relay module to control connection between a power supply device and an electric component.

FIG. 20 illustrates a configuration of a relay module according to the related art and such a relay 90 includes a relay main body 91 formed in a rectangular parallelepiped shape and a plurality of plate-like terminal portions (hereinafter, referred to as relay terminals) 92 protruding in a straight line shape from one surface (bottom surface) of the relay main body 91. In FIG. 20, for the purpose of simplification of the drawing, the relay main body 91 is not illustrated in a cross-sectional view, but only the relay terminals 92 are illustrated in a cross-sectional view.

For example, such a type of relay 90 is assembled into a resinous holding member 95, which holds terminal fittings 94 connected to electrical wires 93, to constitute a relay module. The relay module is assembled into an electrical junction box. A spring portion 96 to which the relay terminal 92 is fitted is formed in each terminal fitting 94, and the relay 90 is held in the holding member 95 by inserting and fitting the tips of the plurality of relay terminals 92 into the spring portions 96.

The relay module according to the related art illustrated in FIG. 20 has a structure in which the relay 90 is held by the holding member 95 by fitting the plurality of relay terminals 92 to the terminal fittings 94. The plurality of relay terminals 92 may be formed in the same shape (for example, with the same width and the same thickness) out of the same material, or some or all thereof may be formed of different materials or may be formed in different shapes. For example, when the relay terminals 92 are formed of different materials or formed in different shapes, the relay terminals 92 have different rigidities and the relay terminals 92 having various rigidities are mixed in one relay 90. Accordingly, the relay terminal 92 having a relatively low rigidity is more easily subjected to damage such as deformation at the time of fitting to the terminal fitting 94 than the relay terminal 92 having a high rigidity. As a result, there is demand for protecting the relay terminal 92 having a low rigidity so as not to cause damage when fitting the plurality of relay terminals 92 having different rigidities to the terminal fitting 94.

SUMMARY OF THE INVENTION

The present invention has been made in consideration of the above-mentioned circumstances and an object thereof is to protect a terminal portion having a low rigidity in fitting terminal portions to the terminal fittings when an electronic component in an electronic component module includes a plurality of terminal portions having different rigidities.

In order to achieve the above-mentioned object, an electronic component assembly structure according to one aspect of the present invention includes an electronic component; a plurality of terminal fittings to which the electronic component is fitted; and a housing member in which the electronic component and the terminal fittings are received. Here, the electronic component includes a main body section having a rectangular parallelepiped shape; and a plurality of terminal portions having different rigidities. The housing member includes a first housing chamber configured to guide and receive the main body section therein; and a second housing chamber configured to receive and hold the terminal fittings therein. The first housing chamber is formed by surrounding four sides thereof with a frame-like wall portion rising upright from a bottom portion, and the second housing chamber is formed outside the wall portion interposed therebetween. Each of the terminal portions includes a base end; and a fitting portion configured to extend from a protruding tip of the base end along a side surface of the main body section with a gap from the side surface and which is fitted to the corresponding terminal fitting. The fitting portions of the terminal portions and the terminal fittings are positioned such that a fitting timing of the fitting portion of the terminal portion having a relatively lower rigidity, among the plurality of terminal portions, to the terminal fitting is more delayed. The electronic component, the terminal fittings, and the housing member are mutually assembled.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an electronic component module having an electronic component assembly structure according to an embodiment of the present invention will be described with reference to the accompanying drawings. In this embodiment, a relay is used as an electronic component, but the electronic component is not limited to the relay and may employ another electronic component having a configuration common to the relay which will be described below, such as a fuse or a module component incorporated into a substrate. Here, "an electronic component having a common configuration" means that the electronic component includes a main body section having a rectangular parallelepiped shape and a plurality of terminal portions having different rigidities, and fitting directions in which the plurality of terminal portions is fitted to a plurality of terminal fittings are set to the same direction.

The usage of the relay module according to this embodiment is not particularly limited, but a case can be considered in which the relay module is used for equipment or the like for controlling a connection state between a power supply device and an electric component in a vehicle such as an automobile. Such a type of relay module can be provided as one constituent member of an electrical junction box, but may be treated as an independent body other than a constituent member of the electrical junction box and may guarantee a relay function even as an independent body.

FIGS. 1 to 4 illustrate a relay assembly structure according to a first embodiment.

Figure 1:
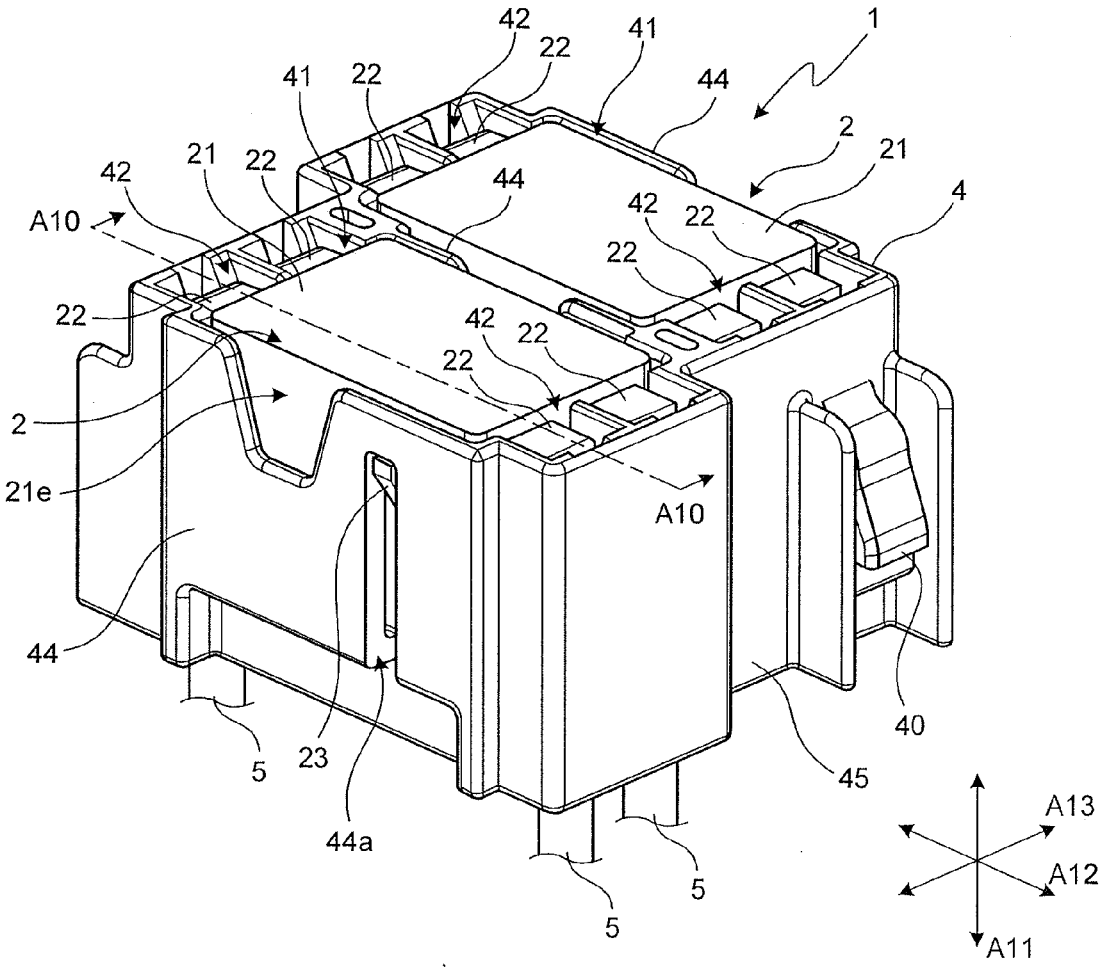
FIG. 1 is a perspective view illustrating the entire configuration of a relay module according to a first embodiment.

FIG. 1 is a perspective view illustrating the entire configuration of a relay module according to the first embodiment.

FIG. 1 illustrates the entire configuration of a relay module 1 according to the first embodiment, in which a relay 2, terminal fittings 3, and a housing member 4 are mutually assembled.

Figure 2:
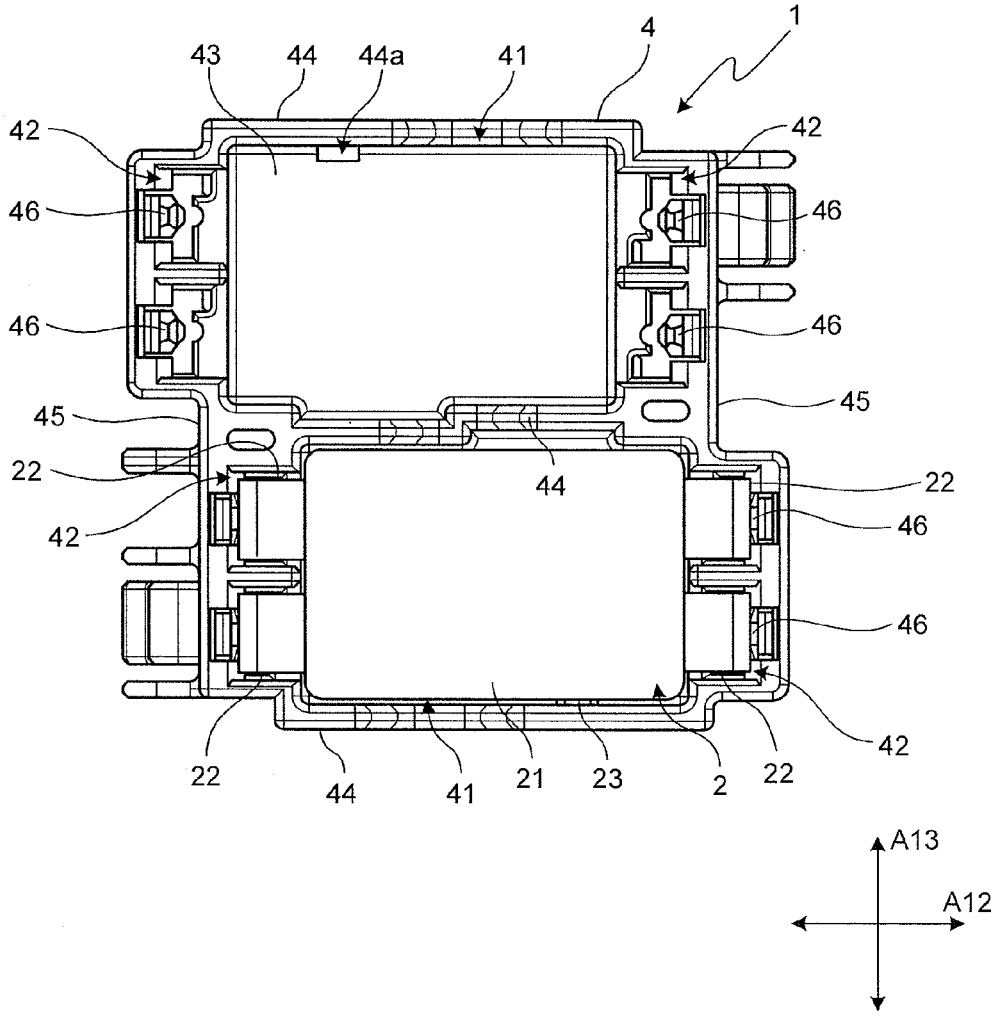
FIG. 2 is a plan view of the relay module illustrated in FIG. 1.

FIG. 2 is a plan view of the relay module illustrated in FIG. 1.

FIG. 2 illustrates a plan view (one of two relays 2 is not illustrated) of the relay module 1.

Figure 3A:
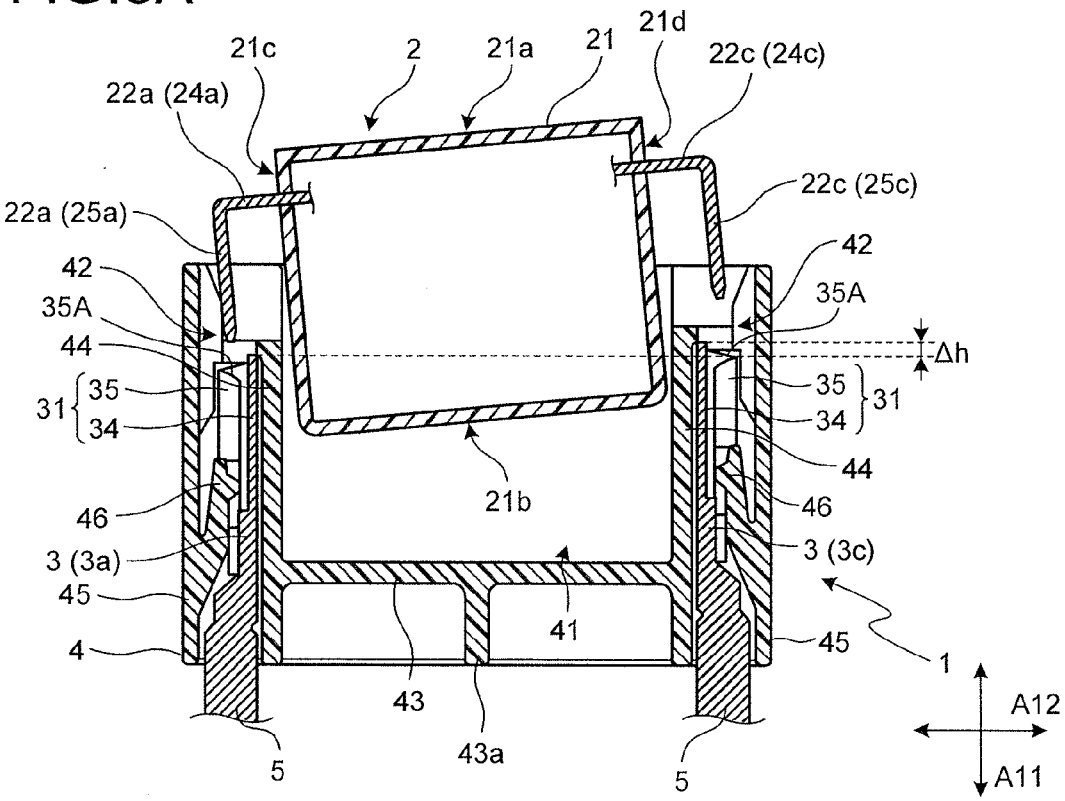
FIG. 3A is a longitudinal-sectional view of the relay module according to the first embodiment when viewed from the direction of arrow A10 in FIG. 1 and is a diagram illustrating a state in which a relay is inclined when the relay is inserted into a housing member.
Figure 3B:
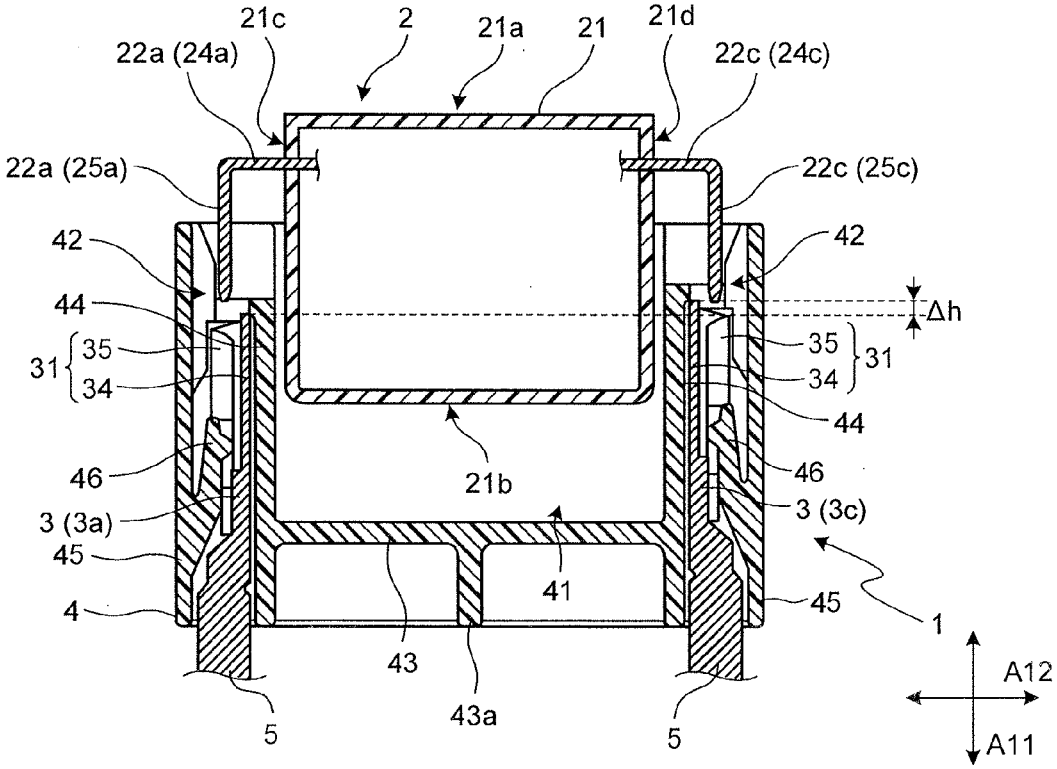
FIG. 3B is a longitudinal-sectional view of the relay module according to the first embodiment when viewed from the direction of arrow A10 in FIG. 1 and is a diagram illustrating a state in which the relay has a proper insertion posture with respect to the housing member.
Figure 4:
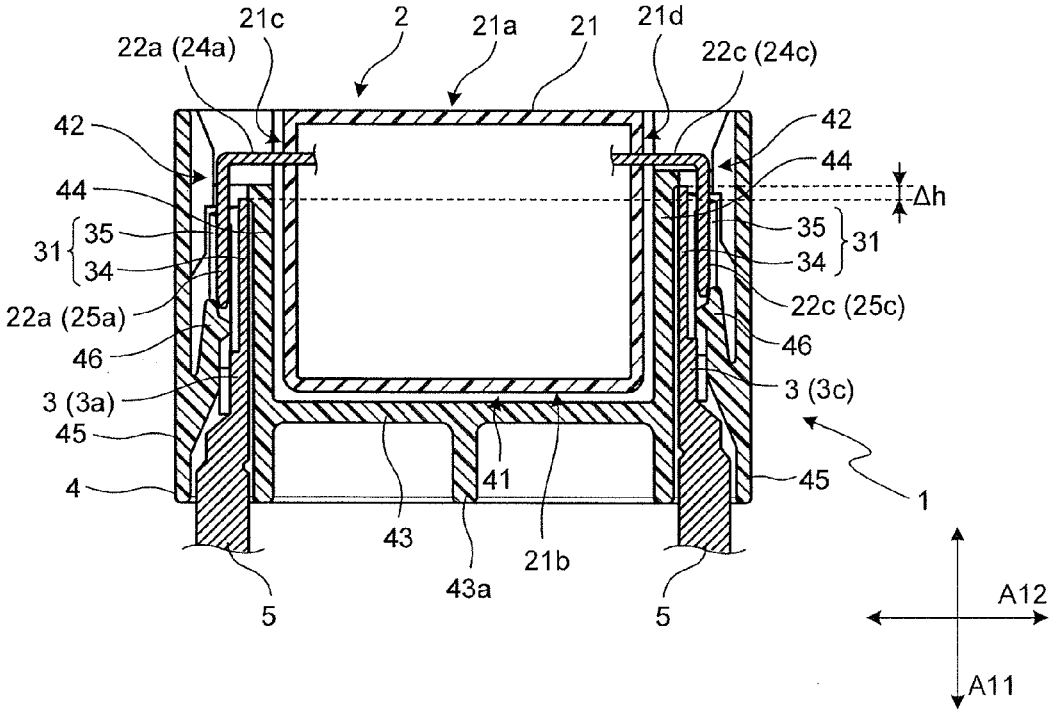
FIG. 4 is a longitudinal-sectional view of the relay module when viewed from the direction of arrow A10 in FIG. 1 and is a diagram illustrating a state in which the relay has been assembled into the housing member.

FIG. 3A is a longitudinal-sectional view of the relay module according to the first embodiment when viewed from the direction of arrow A10 in FIG. 1 and is a diagram illustrating a state in which the relay is inclined when the relay is inserted into the housing member. FIG. 3B is a longitudinal-sectional view of the relay module according to the first embodiment when viewed from the direction of arrow A10 in FIG. 1 and is a diagram illustrating a state in which the relay has a proper insertion posture with respect to the housing member. FIG. 4 is a longitudinal-sectional view of the relay module 1 when viewed from the direction of arrow A10 in FIG. 1 and is a diagram illustrating a state in which the relay 2 has been assembled into the housing member 4. In the following description, a direction (=fitting direction) indicated by arrow A11 in FIG. 1 is defined as an up-down direction, a direction indicated by arrow A12 is defined as a right-left direction, and a direction indicated by arrow A13 is defined as a front-back direction (hereinafter, the same applies to the drawings other than FIG. 1). Regarding the up-down direction, the upward direction (=fitting release direction) in FIG. 1 is defined as upward (upside) and the downward direction (=fitting direction) is defined as downward (downside). However, the up-down direction, the right-left direction, and the front-back direction may not match the respective directions (for example, the up-down direction, the right-left direction, and the front-back direction of a vehicle) in a state in which the relay module 1 is actually mounted on a vehicle.

The internal structure of a relay main body 21 is not illustrated in FIGS. 3A and 3B and FIG. 4 for the purpose of simplification of drawing.

In the first embodiment, the relay module 1 has a configuration in which the relay 2, the terminal fittings 3 to which the relay 2 is fitted, and the housing member 4 that receives the relay 2 and the terminal fittings 3 therein are mutually assembled. The relay 2 includes a main body section (hereinafter, referred to as a relay main body) 21 having a rectangular parallelepiped shape and a plurality of terminal portions (hereinafter, referred to as tabs) 22 having different rigidities. In this embodiment, as illustrated in FIG. 1, it is assumed that one relay module 1 includes two relays 2. However, the number of relays constituting one relay module is not particularly limited and the relay module may include only one relay or may include three or more relays. When the relay module includes a plurality of relays, only the same type of relays 2 may be employed as illustrated in FIG. 1 or other type of relays (for example, relays 2*a* to 2*k* illustrated in FIGS. 9 to 19) may be mixed.

Figure 5:
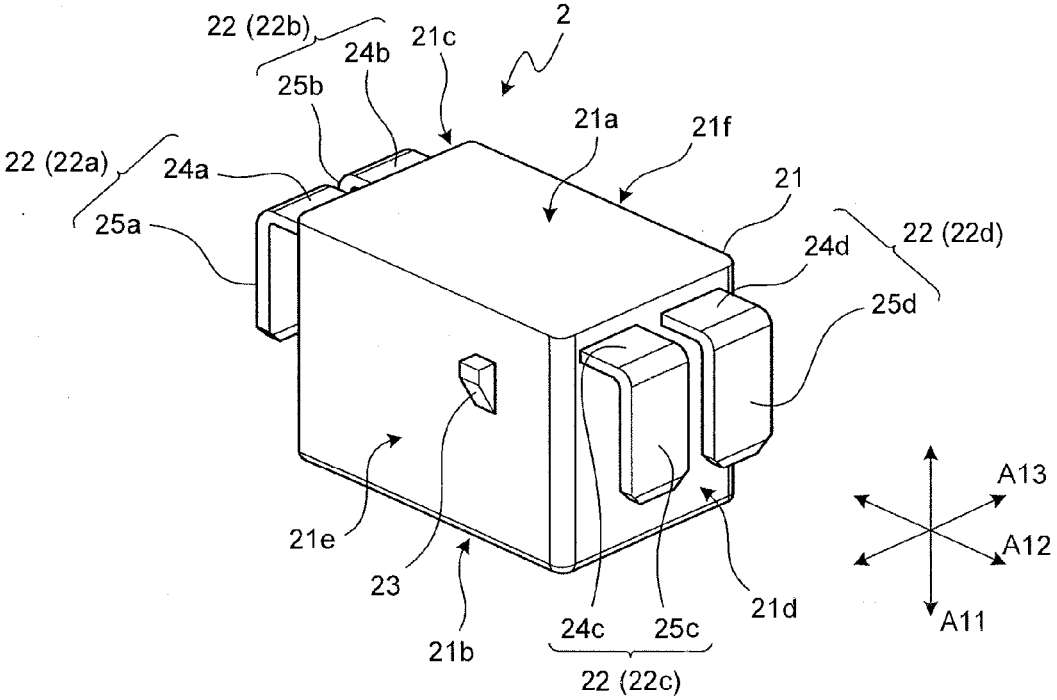
FIG. 5 is a perspective view illustrating a configuration of a relay according to the first embodiment.

FIG. 5 is a perspective view illustrating a configuration of the relay according to the first embodiment.

As illustrated in FIG. 5, the relay 2 has a configuration in which the relay main body 21 in which a relay circuit not illustrated is molded is formed of a resin or the like and conductive metal tabs 22 electrically connected to the relay circuit are disposed in the relay main body 21. The relay main body 21 according to this embodiment is formed in a rectangular parallelepiped shape and has surfaces facing each other in the up-down direction (hereinafter, referred to as a top surface (upper surface) 21*a* and a bottom surface (lower surface) 21*b*), surfaces facing each other in the right-left direction (hereinafter, referred to as a left side surface 21*c* and a right side surface 21*d*), and surfaces facing each other in the front-back direction (hereinafter, referred to as a front surface (front side surface) 21*e* and a back surface (back side surface) 21*f*). In this case, the relay main body 21 is positioned such that the right-left direction is set as the longitudinal direction thereof and four sides, that is, the left side surface 21*c*, the right side surface 21*d*, the front surface 21*e*, and the back surface 21*f* are set as the side surfaces thereof. In this embodiment, the relay main body 21 is formed, for example, in a rectangular parallelepiped shape, but the relay main body as an electronic component may be formed in a square parallelepiped shape. The electronic component main body section is not limited to these shapes and may be formed in shapes in which side surfaces (circumferential surfaces) can be formed along the fitting direction, such as a columnar shape, a polygonal pillar shape, and a cylindrical shape.

The plurality of tabs 22 has different rigidities, but some tabs 22 may have different rigidities or all the tabs 22 may have different rigidities in this case. As a method of giving different rigidities, a method of mixing tabs 22 formed of different materials, a method of mixing tabs 22 having different shapes, for example, tabs 22 having different widths or thicknesses, a method of mixing tabs having different materials and different shapes, and the like can be employed.

In this embodiment, a method of mixing the plurality of tabs 22, which are formed of materials having different rigidities and which have the same shapes, is employed as an example. Each tab 22 includes a base end 24 protruding from the relay main body 21 and a fitting portion 25 which extends from the protruding tip of the base end 24 along a side surface of the relay main body 21 with a gap from the side surface and which is fitted to the terminal fitting 3. That is, the fitting portion 25 is formed of the same material as the base end 24, is bent at an end of the base end 24, and extends along the fitting direction on the side surface of the relay main body 21.

Here, as long as tabs 22 having different rigidities are mixed and separated from each other such that the fitting timing of the fitting portion 25 of the tab 22 having a relatively low rigidity to the terminal fitting 3 delays as will be described later, the protruding position or the protruding length of the base end 24 of each tab 22 from the relay main body 21, the height position of the extending tip of the fitting portion 25 or the extending length from the base end 24, or the like can be arbitrarily set and is not particularly limited.

As illustrated in FIG. 5, the relay 2 according to this embodiment includes four tabs 22 having a plate shape. Hereinafter, the four tabs are mentioned as tabs 22*a*, 22*b*, 22*c*, and 22*d* when it is necessary to distinguish the tabs 22 from each other, and the four tabs are mentioned as tabs 22 when it is not necessary to distinguish the tabs from each other.

Among the four tabs 22, two tabs 22*a* and 22*b* are arranged on the left side surface 21*c* of the relay main body 21 and the other two tabs 22*c* and 22*d* are arranged on the right side surface 21*d*. In this embodiment, the four tabs 22 have the same shape (the same width and the same thickness) and the tabs 22 having two rigidities are mixed in the relay 2 by forming the tabs 22*a* and 22*b* of a material having a lower rigidity than the tabs 22*c* and 22*d*.

In this case, fourth base ends 24*a* to 24*d* protrude from the same height (positions at which the distances from the bottom surface 21*b* in the up-down direction (=direction of A11) are the same) by the same length (size in the right-left direction (=direction of A12)). Four fitting portions 25*a* to 25*d* extend substantially at right angle and downward from the protruding tips of the base ends 24*a* to 24*d* and the positions of the extending tips of the fitting portions 25*a* to 25*d* are arranged at the same height.

Figure 6:
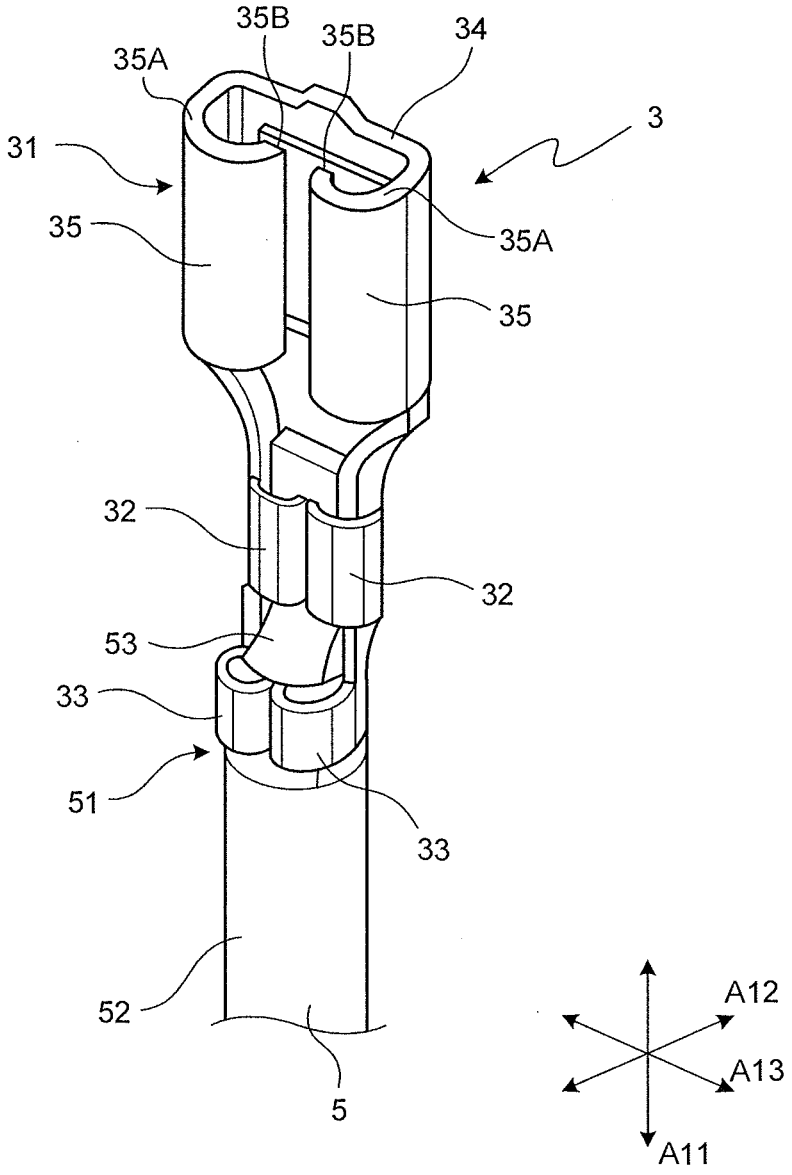
FIG. 6 is a perspective view illustrating a configuration of a terminal fitting according to the first embodiment.

FIG. 6 is a perspective view illustrating a configuration of a terminal fitting according to the first embodiment.

FIG. 6 illustrates an example of the configuration of a terminal fitting 3 according to the first embodiment.

The terminal fitting 3 is an interface member that is connected to a terminal section 51 of an electrical wire 5 so as to electrically connect the electrical wire 5 to the relay 2. The terminal fitting 3 is formed by machining a conductive metal sheet and includes a female connection portion 31 to which the fitting portion 25 of the tab 22 is fitted, a pair of core clamping pieces 32 that caulk a core wire 53 exposed by peeling an insulating coating 52 of the terminal section 51 of the electrical wire 5, and a pair of external clamping pieces 33 that caulk a tip of the insulating coating 52 of the electrical wire 5.

Each connection portion 31 includes a flat plate portion 34 that supports the fitting portion 25 of the fitted tab 22 and a spring portion 35 that presses the fitting portion 25.

Accordingly, the fitting portion 25 of the tab 22 is fitted between the plate portion 34 and the spring portion 35 in a state in which the fitting portion is pressed against the plate portion 34 by the spring portion 35. The spring portion 35 is formed in a pair of convex curve shapes by causing both ends in the font-back direction of the plate portion 34 to rise upright and curving the tip portions thereof toward the vicinity of the center in the front-back direction of the plate portion 34. Accordingly, the spring portion 35 is configured to apply a pressing force (elastic restoration force) to the fitting portion 25 to fit the fitting portion 25 by inserting the fitting portion 25 to elastically deform a tips 35B of the spring portion 35 in a direction in which it is separated from the plate portion 34.

As illustrated in FIGS. 3A, 3B, and 4, the connection portion 31 has a tapered shape in which a top surface 35A of the spring portion 35 is slowly inclined downward from a portion (portion connected to the plate portion 34) in which the spring portion 35 most protrudes upward from the plate portion 34 to a position at which the tip 35B of the spring portion 35 faces the plate portion 34. As a result, when the fitting portion 25 of the tab 22 is fitted to the connection portion 31, the fitting portion 25 can be guided to a position between the plate portion 34 and the spring portion 35 by the tapered top surface 35A.

FIG. 6 illustrates an example of the terminal fitting 3 in which the connection portion 31 is called a fastening type, but the terminal fitting 3 is not limited to this type.

Figure 7:
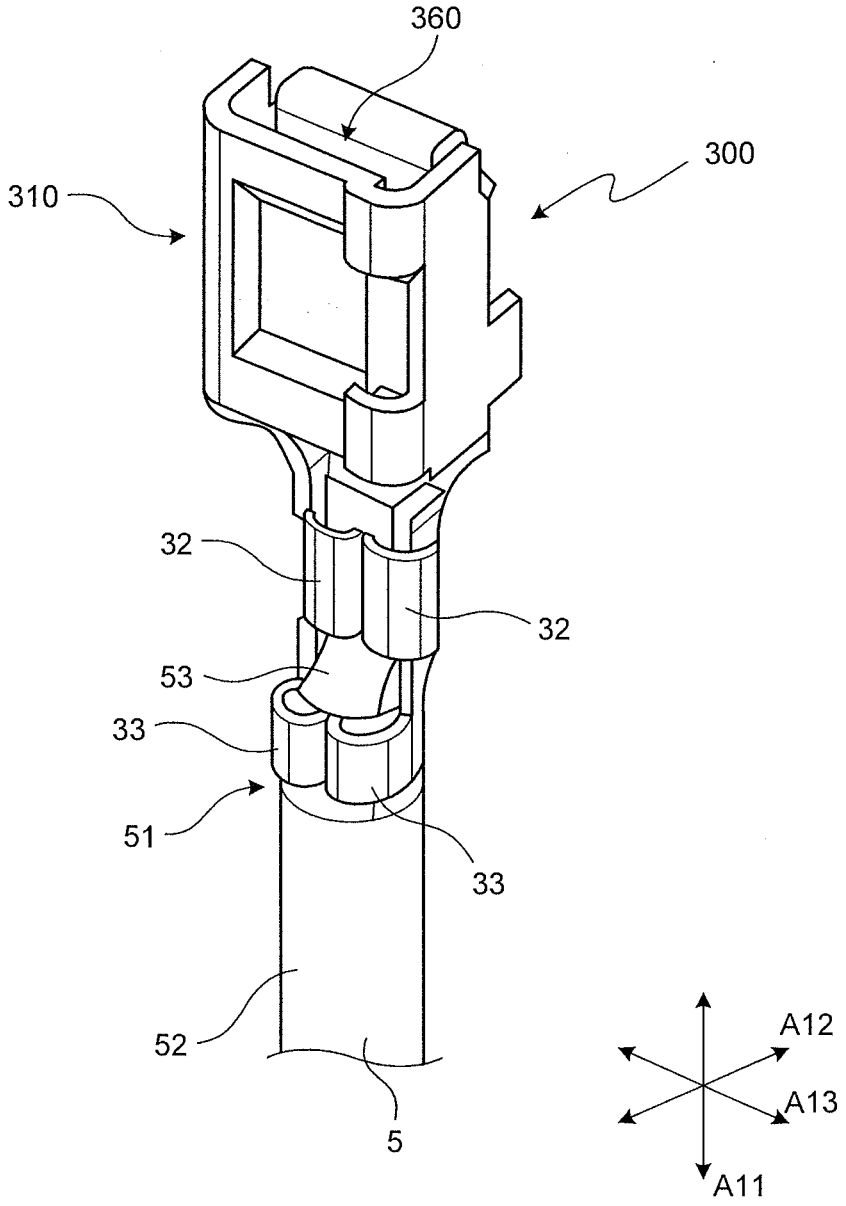
FIG. 7 is a perspective view illustrating another configuration of the terminal fitting according to the first embodiment.

FIG. 7 is a perspective view illustrating another configuration of the terminal fitting according to the first embodiment.

For example, like a terminal fitting 300 according to a modification example illustrated in FIG. 7, a connection portion 310 may be configured to have a substantially tubular shape, to provide the inside of a tubular portion 360 with a plate-like spring portion, and to press the fitting portion 25 of the tab 22 against the inner wall of the tubular portion 360 with the spring portion to fit the fitting portion to the connection portion. In the terminal fitting 300 illustrated in FIG. 7, the same elements as in the terminal fitting 3 (FIG. 6) are referenced by the same reference numerals in the drawings. Alternatively, a tuning fork type terminal fitting having a slot into which the fitting portion 25 of the tab 22 is inserted may be employed. In FIG. 6 or 7, the configuration in which the terminal fitting 3 or the terminal fitting 300 is connected to a terminal section 51 of an electrical wire 5 is illustrated as an example, but the terminal fitting may be connected to a connecting substrate, a connector, or the like.

The housing member 4 is a resinous casing for receiving and holding the relay 2 and the terminal fittings 3. The housing member 4 includes a first housing chamber 41 that guides and receives the relay main body 21 therein and a second housing chamber 42 that receives and holds the terminal fittings 3 therein. In the first embodiment, the housing member 4 is treated as a single member which is independent of the electrical junction box. Accordingly, a locking portion 40 that can engage with a locked portion (for example, locking groove) formed in a casing of the electrical junction box so as to attach the housing member to the casing of the electrical junction box is formed to protrude from the housing member 4. By causing the locking portion 40 to engage with the locked portion, the housing member 4 can be locked and attached to the casing of the electrical junction box. Here, the housing member 4 may be formed as a part of the casing of the electrical junction box and may be treated as a unified body so as not to be detached from the electrical junction box. The numbers of relays 2 and terminal fittings 3 which are received in the housing member 4 are not particularly limited. In this embodiment, as illustrated in FIG. 1, the configuration in which two relays 2 are received in one housing member 4 is assumed. In other words, the housing member 4 includes two sets of relay receiving spaces including one first housing chamber 41 and two second housing chambers 42. Since each relay 2 is provided with four tabs 22, eight terminal fittings 3 are received in one housing member 4. Since two tabs 22 are disposed on each of the left side surface 21*c* and the right side surface 21*d* of the relay main body 21, a pair of second housing chambers 42 are disposed to face each other in the housing member 4 with the first housing chamber 41 interposed therebetween and two terminal fittings 3 are received and held in each second housing chamber 42.

As illustrated in FIG. 4, the height position of the relay main body 21 in a state in which the relay 2 is assembled into the housing member 4 is determined depending on the positions at which the fitting portions 25 of the tabs 22 are fitted to the connection portions 31 of the terminal fittings 3. A top end face 44A of a wall portion 44 is positioned at a predetermined height below the top end face of a frame portion 45 so as not to come in contact with the base ends 24 of the tabs 22 when the fitting portions 25 of the tabs 22 are fitted to the connection portions 31 of the terminal fittings 3. A bottom portion 43 thereof is positioned at a predetermined height which does not come in contact with the bottom surface 21*b* of the relay main body 21. Accordingly, the relay 2 is held in the housing member 4 without interfering with the bottom portion 43 or the top end face of the wall portion 44 except for parts in which the fitting portions 25 of the tabs 22 are fitted to the connection portions 31 of the terminal fittings 3 in the height direction of the housing member 4. As a result, it is possible to satisfactorily connect the tabs 22 to the terminal fittings 3 and thus to stabilize the holding force of the relay 2.

Four sides of the first housing chamber 41 are surrounded with a frame-like wall portion 44 that rises upright from the bottom portion 43 to form a concave space of which the top is opened to the outside as illustrated in FIGS. 1 to 4. The wall portion 44 rises upward from the bottom portion 43 so as to surround the side surfaces (the left side surface 21*c*, the right side surface 21*d*, the front surface 21*e*, and the back surface 21*f*) of the relay main body 21 along the side surfaces. Accordingly, the wall portion 44 guides and receives the relay main body 21 into the first housing chamber 41. In this case, the first housing chamber 41 has a substantially rectangular parallelepiped shape larger than the relay main body 21 so as to smoothly receive the relay main body 21 guided by the wall portion 44.

As illustrated in FIG. 1, a locking groove 44*a* for engaging with a protrusion 23 formed on the front surface 21*e* is formed on the wall portion 44 rising upright to face the front surface 21*e* of the relay main body 21. Accordingly, in a state in which the relay main body 21 is received in the first housing chamber 41, the protrusion 23 can engage with the locking groove 44*a* to lock the relay main body 21 to the first housing chamber 41. That is, the assembling force between the relay 2 and the housing member 4 due to the fitting of the tabs 22 and the terminal fittings 3 can be complemented using the engagement between the protrusion 23 and the locking groove 44*a*. If the complement of the assembling force is not required, the protrusion 23 and locking groove 44*a* may not be provided. As illustrated in FIGS. 3A, 3B, and 4, the bottom portion 43 may be provided with a reinforcing rib 43*a* protruding downward.

The second housing chambers 42 are disposed outside the first housing chamber 41 with the wall portion 44 interposed therebetween, are surrounded with rectangular tubular frames formed by the wall portion 44 and the frame portion 45 of the housing member 4, and forms a rectangular parallelepiped space of which the top and the bottom are opened to the outside. The second housing chambers 42 are provided with an elastically deformable locking piece (hereinafter, referred to as a lance) 46 for holding each terminal fitting 3.

The lance 46 is integrally formed of the same resin as the housing member 4 and extends in a cantilever shape from the frame portion 45 to the spring portion 35. That is, the lance 46 constitutes a so-called spring mechanism, and achieves fixation of the terminal fitting 3 to the second housing chamber 42 and holds the terminal fitting 3 in the second housing chamber 42 by pressing and locking the lower edge of the spring portion 35 with a restoration force from the elastic deformation.

The relay 2 is assembled into the housing member 4 in a state in which the terminal fittings 3 are held in the second housing chambers 42. In the first embodiment, the fitting portions 25 of the tabs 22 and the connection portions 31 of the terminal fittings 3 are positioned such that the fitting timing of the fitting portion 25 of the tab 22 having a relatively lower rigidity to the terminal fitting 3 among the plurality of tabs 22 is more delayed.

In order to cause the fitting timing to delay in this way, it is necessary to adjust the relative positional relationships between the fitting portions 25 of the tabs 22 and the connection portions 31 of the terminal fittings 3 for each tab 22. Accordingly, in this embodiment, for example, the terminal fitting to which the fitting portion 25 of the tab 22 having a relatively lower rigidity among the plurality of terminal fittings 3 is fitted is positioned on a deep side in the fitting direction (to a lower side in the fitting direction, that is, in the up-down direction) and is held in the second housing chamber 42. That is, the height positions (positions in the up-down direction: positions in the fitting direction) of the terminal fittings 3 to which the fitting portions 25*a* and 25*b* of the tabs 22*a* and 22*b* having a low rigidity are fitted are set to be lower by a height difference $\Delta h$ than those of the terminal fittings 3 to which the tabs 22*c* and 22*d* having a higher rigidity than that of the tabs 22*a* and 22*b* are fitted. Since the positions of the extending tips of the fitting portions 25*a* to 25*d* of the tabs 22*a* to 22*d* are arranged at the same height, it is possible to cause the fitting timing of the tabs 22*a* and 22*b* to delay behind the tabs 22*c* and 22*d* by causing the terminal fitting 3 to be positioned at the height. An aspect when the tabs 22 according to this embodiment are fitted to the terminal fittings 3 to assemble the relay 2 into the housing member 4 will be described below with reference to FIGS. 3A, 3B, and 4.

As illustrated in FIGS. 3A, 3B, and 4, in assembling the relay 2 into the housing member 4, the relay main body 21 is inserted into the first housing chamber 41 and the inserted relay main body 21 is guided along the wall portion 44. At this time, when the relay 2 is inclined, the relay main body 21 comes in contact with the wall portion 44. FIG. 3A illustrates a state in which the relay 2 is slightly inclined to the tab 22*a* having a low rigidity. By guiding the relay main body 21 along the wall portion 44 in this state, the relay 2 can be set to a proper insertion posture (a posture in which the relay 2 is not inclined but is parallel to the up-down direction) with respect to the housing member 4 as illustrated in FIG. 3B, and the tabs 22*a* and 22*c* can be directed in the proper insertion direction (downward in the up-down direction) into terminal fittings 3*a* and 3*c*.

On the other hand, the terminal fitting 3*a* to which the tab 22*a* having a low rigidity is fitted has a height position (position in the up-down direction: position in the fitting direction) lower than that of the terminal fitting 3*c* to which the tab 22*c* having a higher rigidity than that of the tab 22*a* is fitted. Accordingly, when the tabs 22*a* and 22*c* are directed in the proper insertion direction (the state illustrated in FIG. 3B), the extending tip of the fitting portion 25*a* of the tab 22*a* is further separated from the connection portion 31 of the terminal fitting 3 than the fitting portion 25*c* of the tab 22*c*.

Accordingly, when the tabs 22*a* and 22*c* are inserted into the terminal fittings 3*a* and 3*c*, the fitting portion 25*c* is first fitted to the connection portion 31 of the terminal fitting 3*c* and then the fitting portion 25*a* is fitted to the connection portion 31 of the terminal fitting 3*a*. That is, since the fitting timing of the tabs 22*a* and 22*c* can be caused to delay, it is possible to cause the fitting timing of the tab 22*a* having a low rigidity to delay behind that of the tab 22 having a high rigidity. At the timing point at which the tab 22*a* is fitted to the terminal fitting 3*a*, the fitting of the tab 22*c* to the terminal fitting 3*c* is started and the relay 2 has the proper insertion posture. Accordingly, it is possible to surely direct the tab 22*a* in the proper insertion direction and to smoothly fit the fitting portion 25*a* to the connection portion 31 of the terminal fitting 3*a*. As a result, it is possible to protect even the tab 22*a* having a low rigidity and thus to satisfactorily prevent damage such as deformation from occurring at the time of fitting to the terminal fitting 3*a*. In this way, according to the first embodiment, it is possible to assemble the relay 2 into the housing member 4 while protecting the tab 22*a* having a low rigidity (the state illustrated in FIG. 4). The movements of the tabs 22*a* and 22*b* relative to the tabs 22*c* and 22*d* in assembling the relay 2 into the housing member 4 are the same and the tab 22*b* having a low rigidity can be protected similarly to the tab 22*a*.

FIG. 3A illustrates a state in which the relay 2 is slightly inclined to the tab 22*a* having a low rigidity in assembling the relay 2 into the housing member 4. However, even when the relay 2 is slightly inclined to the tab 22*c* having a high rigidity, the relay main body 21 inserted into the first housing chamber 41 is similarly guided along the wall portion 44. Accordingly, even in this case, since the fitting of the tab 22*c* to the terminal fitting 3*c* can be started before the tab 22*a* is fitted to the terminal fitting 3*a*, it is possible to surely direct the tab 22*a* in the proper insertion direction. As a result, it is possible to prevent damage such as deformation from occurring in the tab 22*a* in fitting to the terminal fitting 3*a*. The same advantages can be, of course, achieved even when the relay 2 is not inclined and the tabs 22*a* and 22*c* are inserted into the terminal fittings 3*a* and 3*c* in the proper insertion posture illustrated in FIG. 3B.

In this embodiment, in order to cause the fitting timing of the tabs 22*a* and 22*b* having a low rigidity to delay behind that of the tabs 22*c* and 22*d* having a high rigidity, the relative positional relationship between the fitting portions 25 of the tabs 22 and the connection portions 31 of the terminal fittings 3 are adjusted depending on the height positions of the terminal fittings 3. However, like in a second embodiment of the present invention illustrated in FIGS. 8A and 8B, the same operational advantages can be achieved even when the positional relationships are adjusted depending on the height positions of the tabs 22.

The second embodiment will be described below. The basic configuration of a relay module 10 according to the second embodiment is the same as the relay module 1 according to the first embodiment. Accordingly, elements equal or similar to those in the first embodiment will be referenced by the same reference numerals in the drawings and differences from the first embodiment will be described below.

Figure 8A:
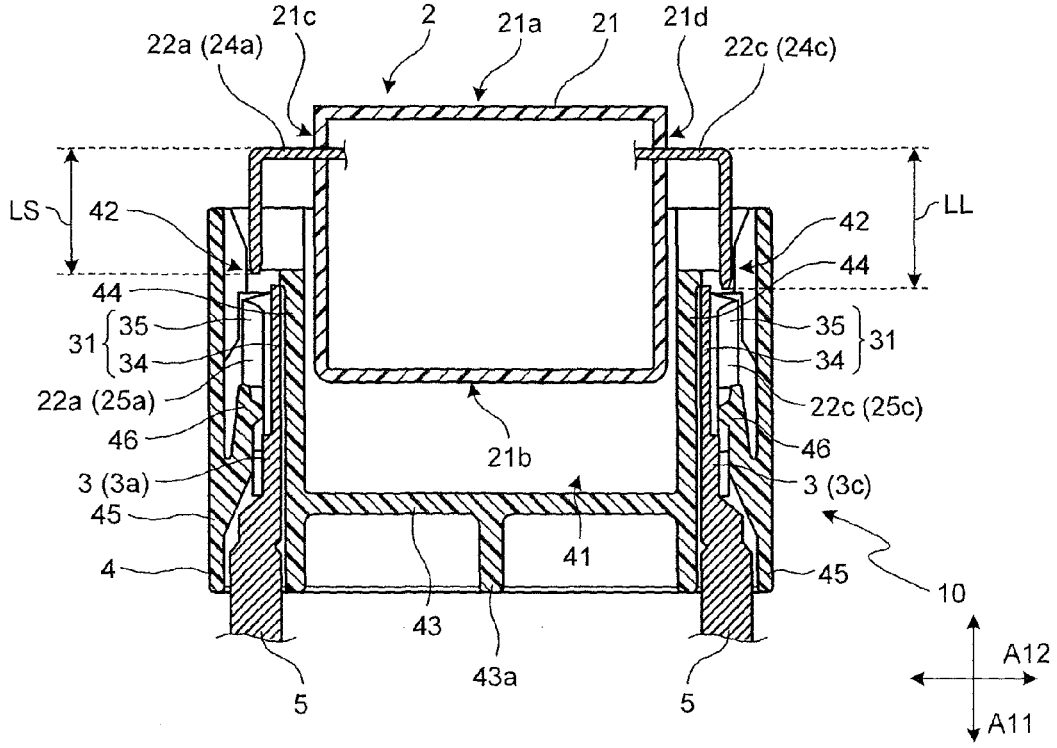
FIG. 8A is a longitudinal-sectional view of a relay module according to a second embodiment when viewed from the direction corresponding to arrow A10 in FIG. 1 and is a diagram illustrating a state in which a relay has a proper insertion posture with respect to a housing member.
Figure 8B:
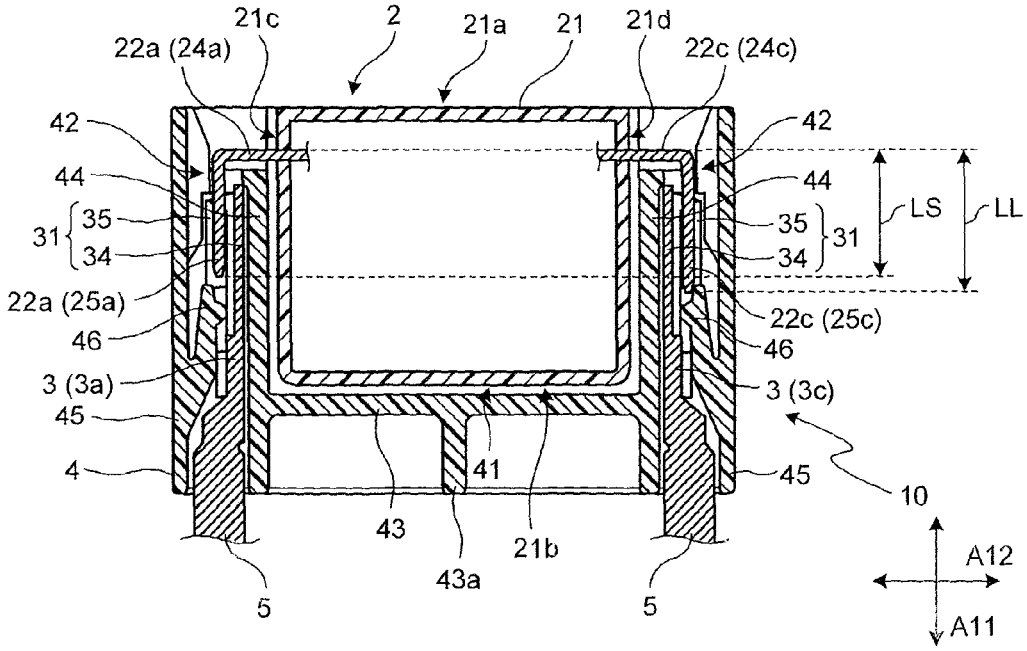
FIG. 8B is a longitudinal-sectional view of the relay module according to the second embodiment when viewed from the direction corresponding to arrow A10 in FIG. 1 and is a diagram illustrating a state in which the relay has been assembled into the housing member.

FIG. 8A is a longitudinal-sectional view of the relay module according to the second embodiment when viewed from the direction corresponding to arrow A10 in FIG. 1 and is a diagram illustrating a state in which the relay has a proper insertion posture with respect to the housing member. FIG. 8B is a longitudinal-sectional view of the relay module according to the second embodiment when viewed from the direction corresponding to arrow A10 in FIG. 1 and is a diagram illustrating a state in which the relay has been assembled into the housing member.

As illustrated in FIGS. 8A and 8B, in this embodiment, the position of the extending tip of the fitting portion 25 of the tab 22 having a low rigidity among the fitting portions 25 of the plurality of tabs 22 is positioned on a shallow side in the fitting direction and extends from the protruding tip of the base end 24. That is, the position of the extending tip of the fitting portion 25*a* of the tab 22*a* having a low rigidity is set to a position higher than the fitting portion 25*c* of the tab 22*c* having a high rigidity. In other words, the length LS of the fitting portion 25*a* of the tab 22*a* having a low rigidity is smaller than the length LL of the fitting portion 25*c* of the tab 22*c* having a high rigidity (LS<LL). On the other hand, the positions of the terminal fittings 3*a* and 3*c* to which the fitting portions 25*a* and 25*c* of the tabs 22*a* and 22*c* are fitted are arranged at the same height (the same position in the up-down direction: the same position in the fitting direction). Accordingly, it is possible to cause the fitting timing of the tab 22*a* to delay behind that of the tab 22*c*.

That is, in this embodiment, in the state in which the relay main body 21 is guided along the wall portion 44 in assembling the relay 2 into the housing member 4 and the tabs 22*a* and 22*c* are directed in the proper insertion direction (the state illustrated in FIG. 8A), the extending tip of the fitting portion 25*c* of the tab 22*c* can be set to be closer to the connection portion 31 of the terminal fitting 3 than that the fitting portion 25*a* of the tab 22*a*. Accordingly, similarly to the first embodiment, it is possible to cause the fitting timings of the tabs 22*a* and 22*c* to delay and to cause the fitting timing of the tab 22*a* having a low rigidity to delay behind that of the tab 22 having a high rigidity. As a result, it is possible to protect even the tab 22*a* having a low rigidity and to assemble the relay 2 into the housing member 4 while preventing the tab having a low rigidity from being subjected to damage such as deformation at the time of fitting to the terminal fitting 3*a* (the state illustrated in FIG. 8B). The movements of the tabs 22*a* and 22*b* relative to the tabs 22*c* and 22*d* in assembling the relay 2 into the housing member 4 are the same and the tab 22*b* having a low rigidity can be protected similarly to the tab 22*a*.

As long as the relay according to the present invention includes a plurality of tabs 22 having different rigidities and each tab 22 includes a base end 24 protruding from a relay main body 21 having a rectangular parallelepiped shape and a fitting portion 25 extending from the protruding tip of the base end 24 along a side surface of the relay main body 21 with a gap from the side surface and being fitted to a terminal fitting 3, the relay is not limited to the configuration illustrated in FIG. 5. For example, configurations of relays according to first to eleventh modification examples illustrated in FIGS. 9 to 19 can be employed as will be described later. Even when these modification examples are employed, the same operational advantages as in the relay 2 can be achieved. FIGS. 9 to 19 illustrate modification examples which can be applied to the first embodiment in which the tabs 22 having different rigidities are mixed by forming all the tabs 22 in the same shape (the same width and the same thickness) and forming a certain tab 22 out of a material having a lower rigidity than that of the other tabs 22. On the other hand, when the modification examples are applied to the second embodiment, the position of the extending tip of the fitting portion 25 of the tab 22 having a low rigidity can be positioned on the shallow side in the fitting direction and the fitting portion can extend from the protruding tip of the base end 24.

The relay configurations according to the first to eleventh modification examples will be described below. The basic configurations of the relays according to the modification examples are the same as the relay 2 according to the above-mentioned embodiments. Accordingly, elements equal or similar to those in the embodiments will be referenced by the same reference numerals in the drawings, description thereof will not be repeated, and differences from the relay 2 will be described below. When the relay configurations according to the modification examples are employed, the terminal fittings 3 and the housing member 4 may be configured to correspond to the relay configurations (specifically, the arrangement of the tabs of the relays) such that the first housing chamber 41 and the second housing chambers 42 are disposed in the housing member 4, that is, the positions of the second housing chambers 42 relative to the first housing chamber 41 are set and the terminal fittings 3 are held in the second housing chambers 42. When the relay configurations according to the modification examples are applied to the first embodiment, the terminal fitting 3 to which the fitting portion 25 of the tab 22 having a relatively low rigidity among a plurality of terminal fittings 3 is fitted can be positioned on a deep side (lower side in the up-down direction) in the fitting direction and can be held in the second housing chamber 42. On the other hand, when the modification examples are applied to the second embodiment, all the positions of the terminal fittings 3 can be arranged at the same height. In any modification example, the number of tabs 22, the protruding positions or the protruding lengths of the base ends 24, and the like can be arbitrarily set.

Figure 9:
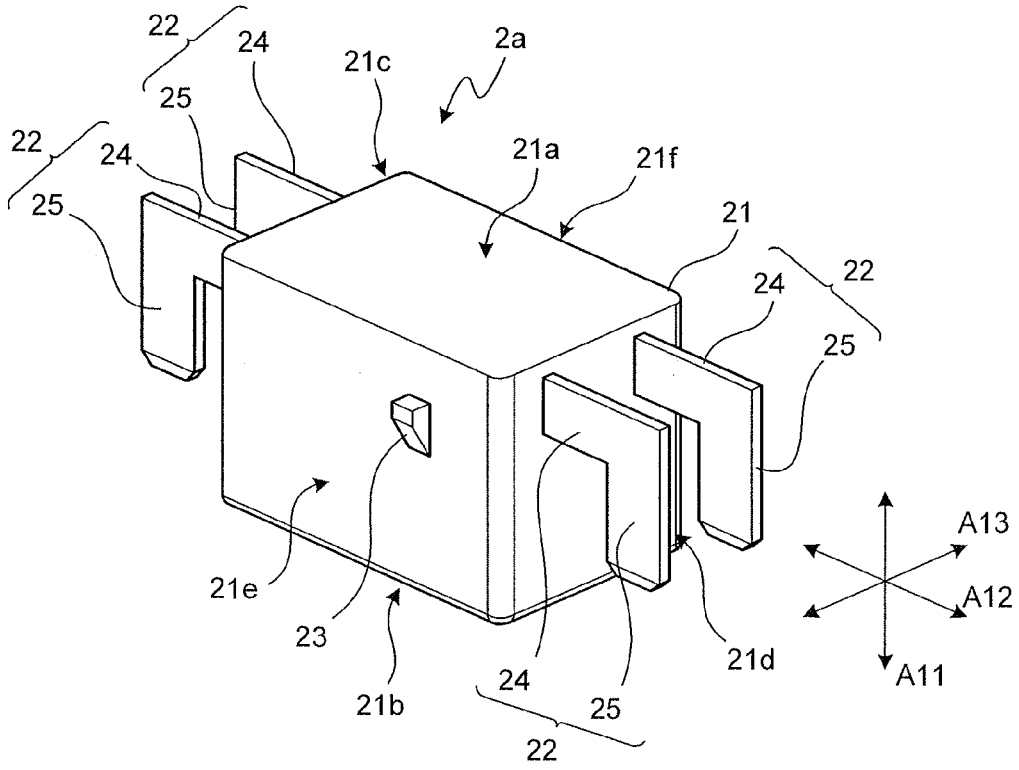
FIG. 9 is a perspective view illustrating a configuration of a relay according to a first modification example.

FIG. 9 is a perspective view illustrating a configuration of a relay according to the first modification example.

As illustrated in FIG. 9, in the relay 2*a* according to the first modification example, each tab 22 has a configuration in which the base end 24 and the fitting portion 25 are formed in a plate shape extending in parallel with the front surface 21*e* and the back surface 21*f*. In this case, the relay 2*a* includes four tabs 22, two tabs 22 thereof are disposed on the left side surface 21*c* of the relay main body 21 and the other two tabs are disposed on the right side surface 21*d*. The base ends 24 of the four tabs 22 protrude by the same length at the same height (the same position in the up-down direction). Two tabs 22 on each side surface (the left side surface 21*c* and the right side surface 21*d*) protrude from the side surface at a constant interval (which may differ) in the front-back direction. The fitting portions 25 of the four tabs 22 are bent substantially at right angle and downward from the protruding tips of the base ends 24 and extend to be parallel to the front surface 21*e* and the back surface 21*f*. Here, the fitting portions 25 extend by the same size from the base ends 24 such that the positions (heights) of the extending tips in the up-down direction are the same.

In the configurations of the relays illustrated in FIGS. 5 and 9, the base ends 24 of the tabs 22 protrude from a pair of side surfaces (the left side surface 21*c* and the right side surface 21*d*) located in the longitudinal direction (the right-left direction) of the relay main body 21, but the base ends 24 may protrude from only one side surface, from two neighboring side surfaces, or from more side surfaces.

Figure 10:
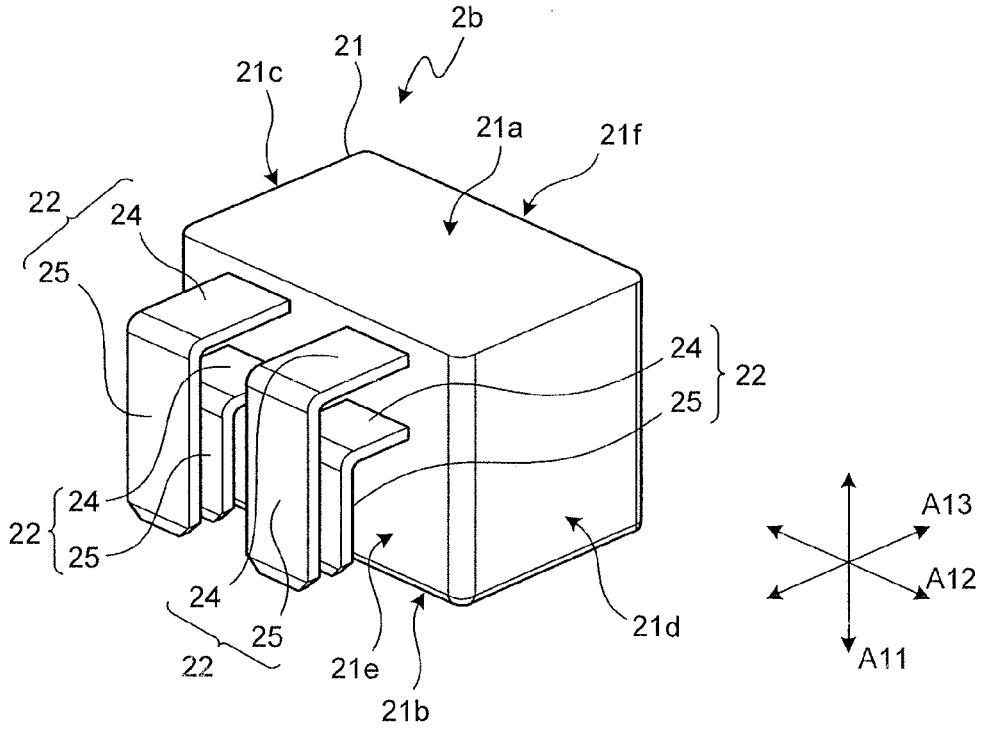
FIG. 10 is a perspective view illustrating a configuration of a relay according to a second modification example.

FIG. 10 is a perspective view illustrating a configuration of a relay according to the second modification example.

Figure 11:
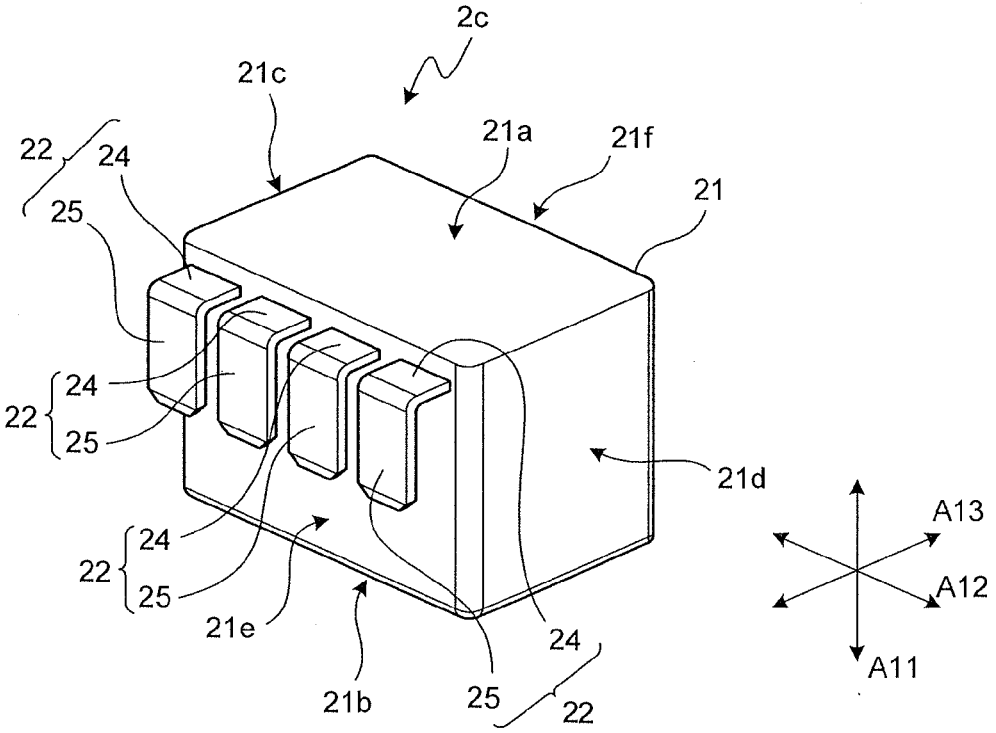
FIG. 11 is a perspective view illustrating a configuration of a relay according to a third modification example.

FIG. 11 is a perspective view illustrating a configuration of a relay according to the third modification example.

FIG. 10 illustrates the configuration of the second modification example in which the base ends 24 of the tabs 22 protrude from only one side surface (the front surface 21*e*) of the relay main body 21.

FIG. 11 illustrates the configuration of the third modification example in which the base ends 24 of the tabs 22 protrude from only one side surface (the front surface 21*e*) of the relay main body 21.

In the relay 2*b* according to the second modification example illustrated in FIG. 10, the base ends 24 of two tabs 22 among four tabs 22 protrude from the vicinity of the top end on the front surface 21*e* and the base ends 24 of the other two tabs 22 protrude from a lower height position.

On the other hand, in the relay 2*c* according to the third modification example illustrated in FIG. 11, the base ends 24 of four tabs 22 protrude from the same height position (same position in the up-down direction: same position in the fitting direction) in the vicinity of the top end on the front surface 21*e*.

Figure 12:
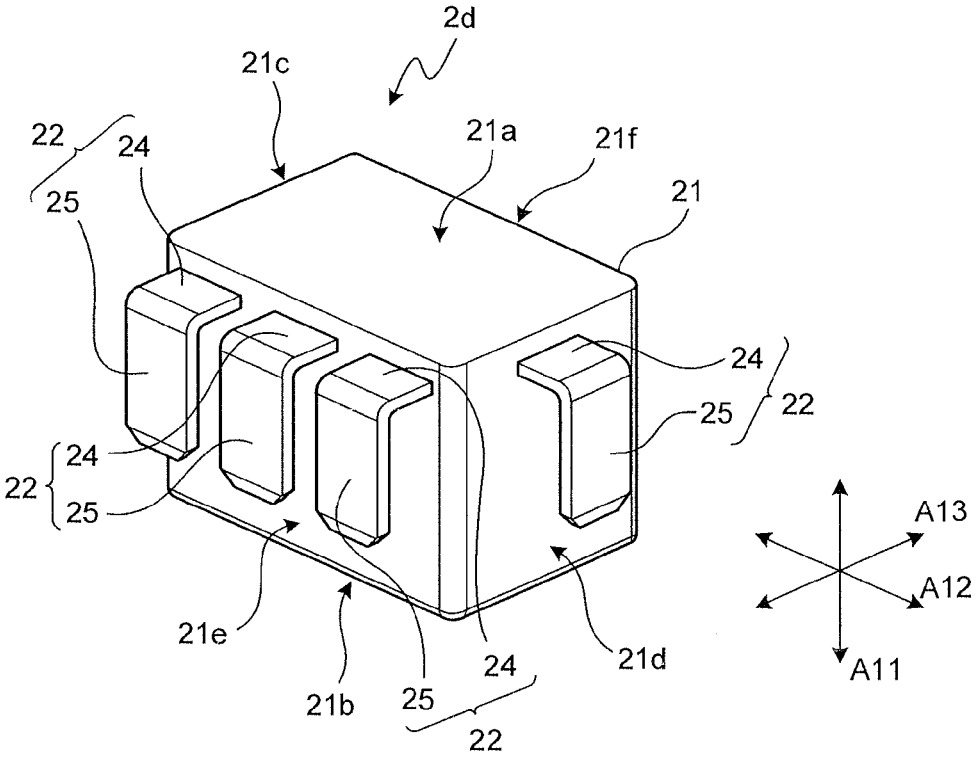
FIG. 12 is a perspective view illustrating a configuration of a relay according to a fourth modification example.

FIG. 12 is a perspective view illustrating a configuration of a relay according to the fourth modification example.

Figure 13:
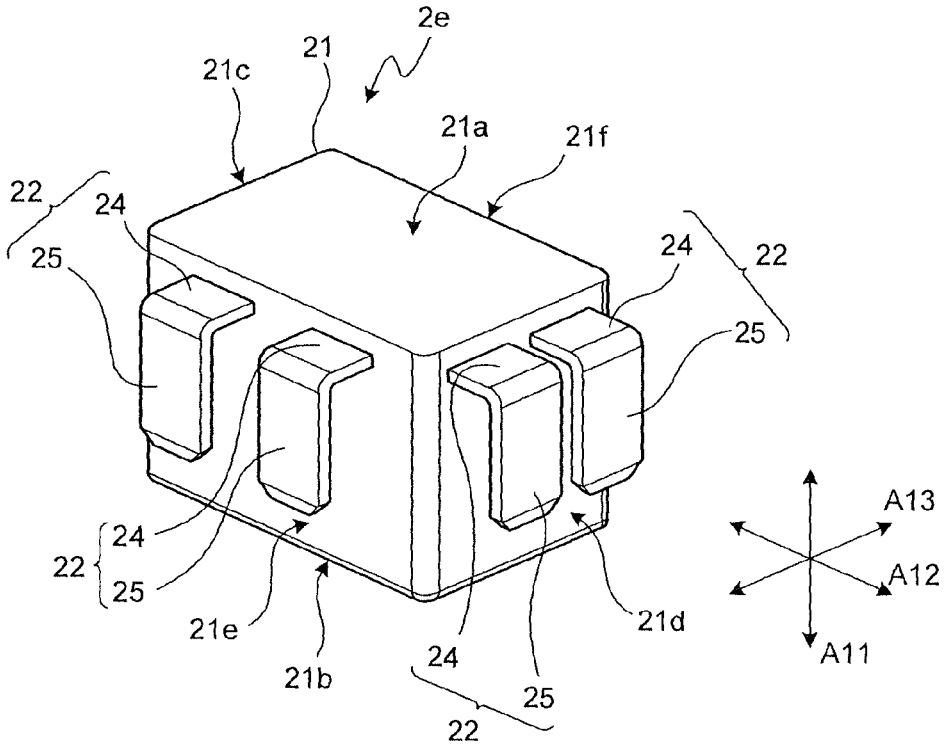
FIG. 13 is a perspective view illustrating a configuration of a relay according to a fifth modification example.

FIG. 13 is a perspective view illustrating a configuration of a relay according to the fifth modification example.

FIG. 12 illustrates the configuration of the fourth modification example in which the base ends 24 of the tabs 22 protrude from two neighboring side surfaces (the front surface 21*e* and the right side surface 21*d*) of the relay main body 21.

FIG. 13 illustrates the configuration of the fifth modification example in which the base ends 24 of the tabs 22 protrude from two neighboring side surfaces (the front surface 21*e* and the right side surface 21*d*) of the relay main body 21.

In the relay 2*d* according to the fourth modification example illustrated in FIG. 12, the base ends 24 of three tabs 22 among four tabs 22 protrude from the vicinity of the top end on the front surface 21*e*. The base end 24 of the other one tab 22 protrudes at the same height as the base ends 24 of the three tabs 22 from the right side surface 21*d*.

Unlike the fourth modification example, in the relay 2*e* according to the fifth modification example illustrated in FIG. 13, the base ends 24 of two tabs 22 among four tabs 22 protrude from the vicinity of the top end on the front surface 21*e*. The base ends 24 of the other two tabs 22 protrude at the same height as the base ends 24 of the two tabs 22 from the right side surface 21*d*.

Figure 14:
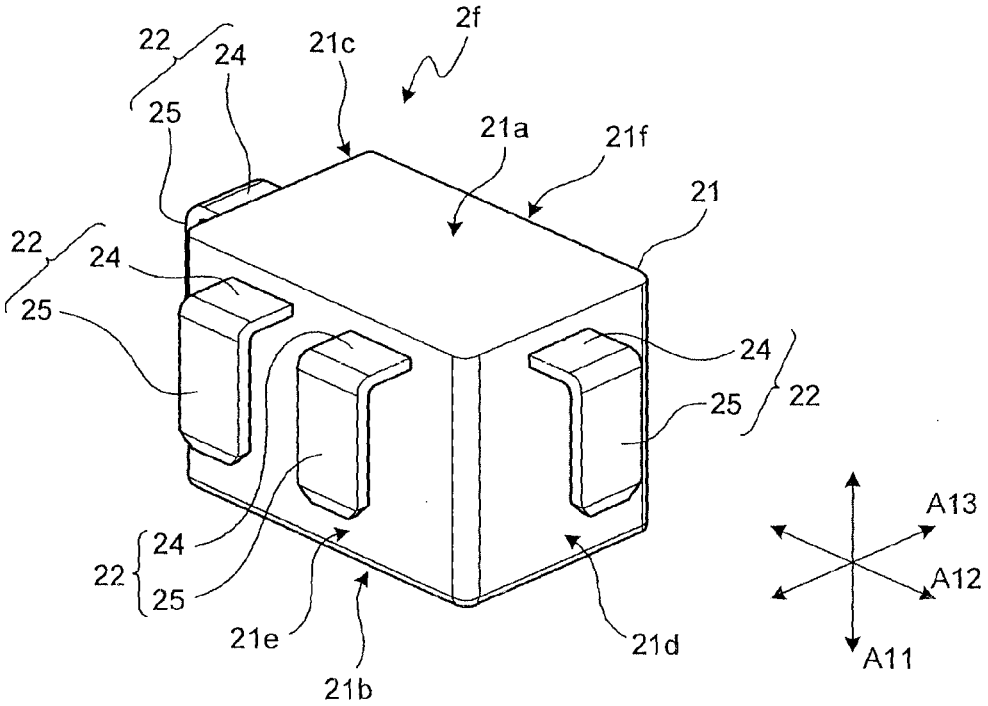
FIG. 14 is a perspective view illustrating a configuration of a relay according to a sixth modification example.

FIG. 14 is a perspective view illustrating a configuration of a relay according to the sixth modification example.

FIG. 14 illustrates the configuration of the sixth modification example in which the base ends 24 of the tabs 22 protrude from three side surfaces (the left side surface 21*c*, the front surface 21*e*, and the right side surface 21*d*) of the relay main body 21.

In the relay 2*f* according to the sixth modification example, among four tabs 22, one tab protrudes from the left side surface 21*c*, two tabs protrude from the front surface 21*e*, and one tab protrudes from the right side surface 21*d*.

In the first to sixth modification examples (FIGS. 9 to 14), the fitting portions 25 of four tabs 22 are bent substantially at right angle and downward from the protruding tips of the base ends 24 and extend to be parallel to the side surfaces from which the base ends 24 protrude. Here, the fitting portions 25 of the four tabs 22 extend by the same size from the base ends 24 such that the positions (heights) of the extending tips thereof in the up-down direction (the fitting direction) are equal to each other. The neighboring tabs 22 on the same side surface are arranged at a constant interval (which may differ).

In the configurations of the relays illustrated in FIG. 5 and FIGS. 9 to 14, the base ends 24 of the tabs 22 protrude from the side surfaces of the relay main body 21, but the base ends 24 may protrude from the top surface 21*a* of the relay main body 21 as in the seventh to eleventh modification examples illustrated in FIGS. 15 to 19. In the seventh to eleventh modification examples, the base ends 24 of four tabs 22 protrude from the top surface 21*a* and are bent substantially at right angle and extend to the side surfaces. The fitting portions 25 of the tabs 22 are bent substantially at right angle and downward from the base ends 24 and extend by the same dimension from the base ends 24 such that the positions (heights) of the extending tips thereof in the up-down direction are the same.

Figure 15:
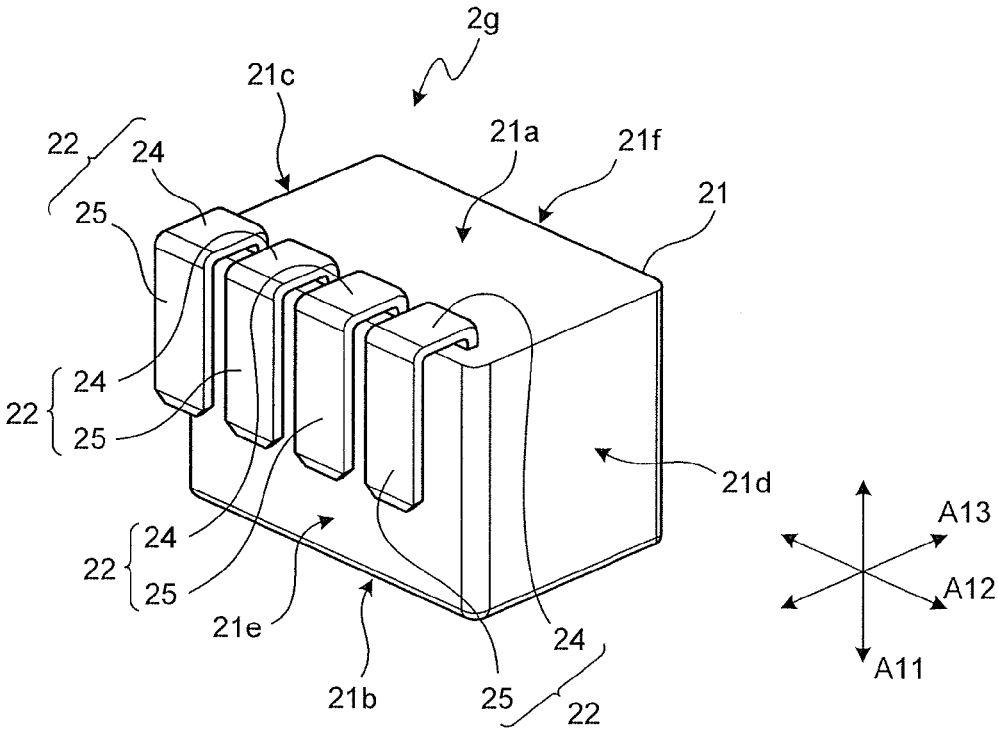
FIG. 15 is a perspective view illustrating a configuration of a relay according to a seventh modification example.

FIG. 15 is a perspective view illustrating a configuration of a relay according to the seventh modification example.

Figure 16:
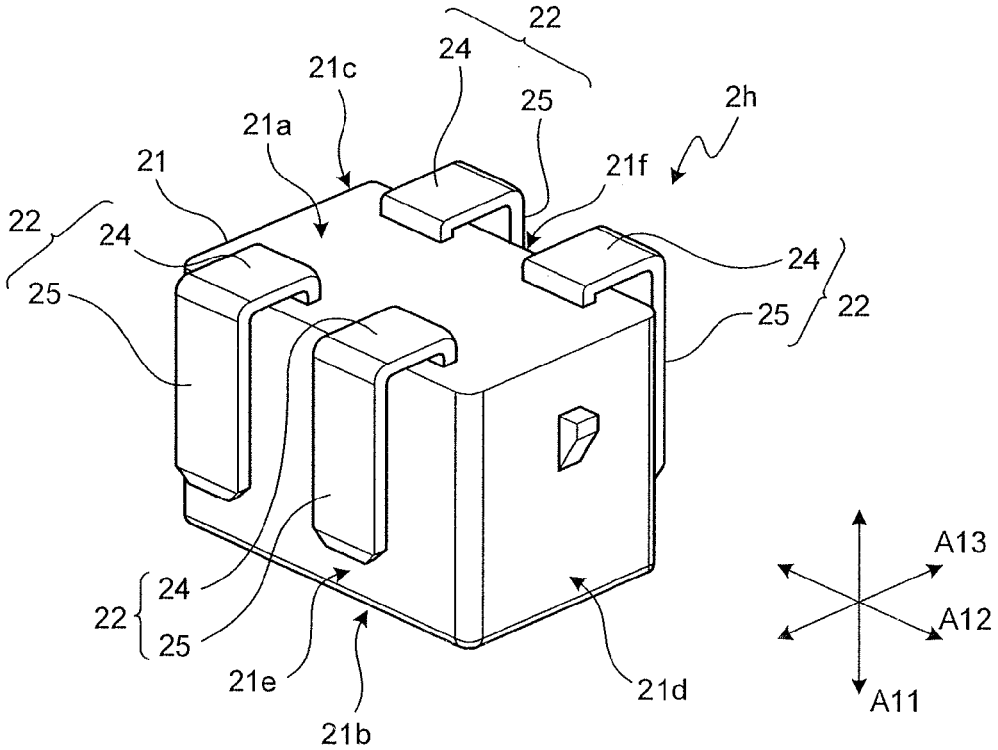
FIG. 16 is a perspective view illustrating a configuration of a relay according to an eighth modification example.

FIG. 16 is a perspective view illustrating a configuration of a relay according to the eighth modification example.

Figure 17:
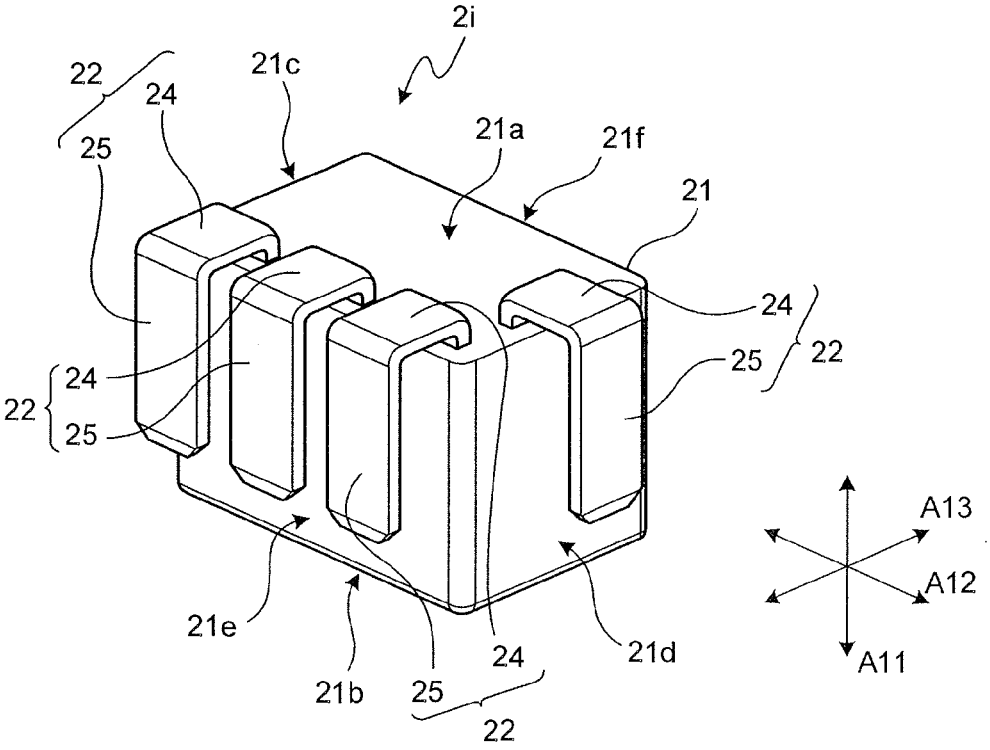
FIG. 17 is a perspective view illustrating a configuration of a relay according to a ninth modification example.

FIG. 17 is a perspective view illustrating a configuration of a relay according to the ninth modification example.

Figure 18:
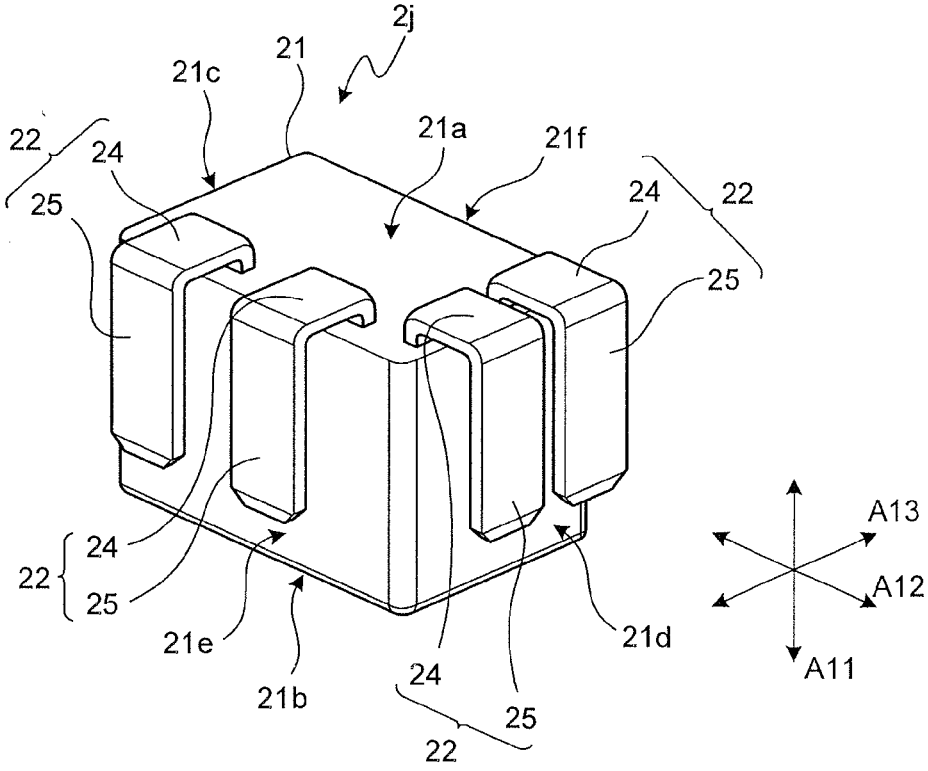
FIG. 18 is a perspective view illustrating a configuration of a relay according to a tenth modification example.

FIG. 18 is a perspective view illustrating a configuration of a relay according to the tenth modification example.

Figure 19:
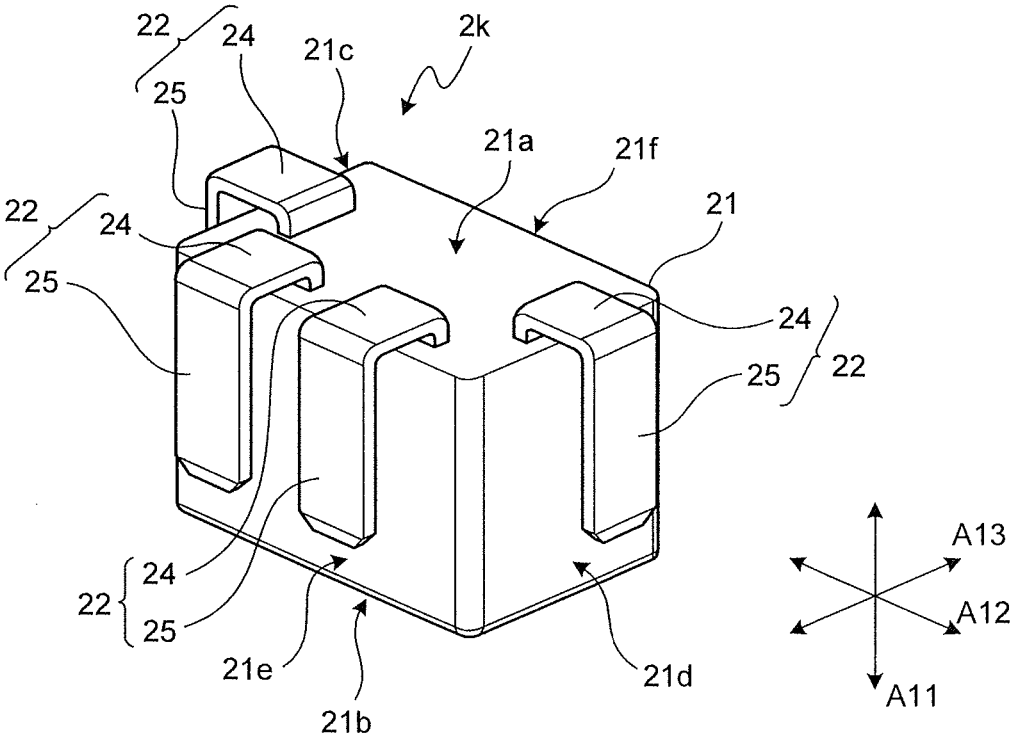
FIG. 19 is a perspective view illustrating a configuration of a relay according to an eleventh modification example.
Figure 20:
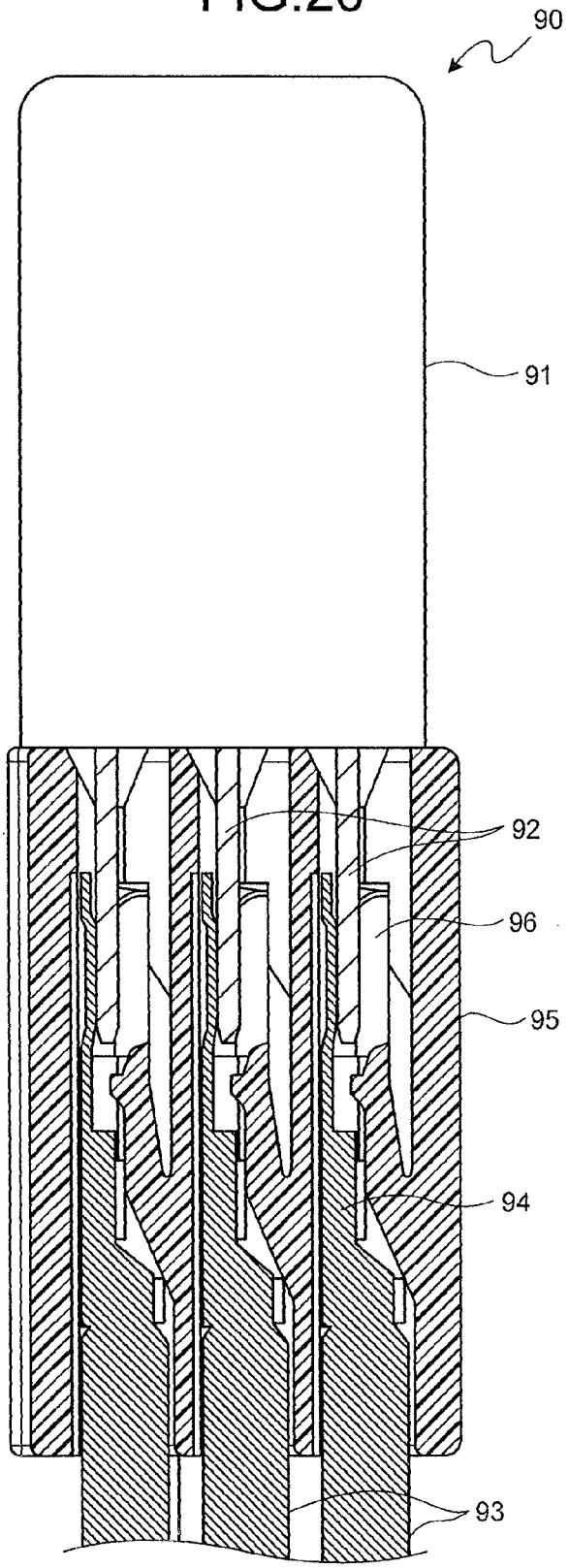
FIG. 20 is a longitudinal-sectional view illustrating a relay module according to the related art.

FIG. 19 is a perspective view illustrating a configuration of a relay according to the eleventh modification example.

As illustrated in FIG. 15, in the relay 2*g* according to the seventh modification example, the fitting portions 25 of four tabs 22 extend from the base ends 24 to be parallel to the front surface 21*e*.

As illustrated in FIG. 16, in the relay 2*h* according to the eighth embodiment, among the fitting portions 25 of four tabs 22, two fitting portions extend from the base ends 24 to be parallel to the front surface 21*e* and the other two fitting portions extend from the base ends 24 to be parallel to the back surface 21*f*.

As illustrated in FIG. 17, in the relay 2*i* according to the ninth embodiment, among the fitting portions 25 of four tabs 22, three fitting portions extend from the base ends 24 to be parallel to the front surface 21*e* and the other one fitting portion extends from the base end 24 to be parallel to the right side surface 21*d*.

As illustrated in FIG. 18, in the relay 2*j* according to the tenth embodiment, among the fitting portions 25 of four tabs 22, two fitting portions extend from the base ends 24 to be parallel to the front surface 21*e* and the other fitting portions 25 of the remaining two tabs 22 extend from the base ends 24 to be parallel to the right side surface 21*d*.

As illustrated in FIG. 19, in the relay 2*k* according to the eleventh embodiment, among the fitting portions 25 of four tabs 22, one fitting portion extends from the base end 24 to be parallel to the left side surface 21*c*, two fitting portions extend from the base ends 24 to be parallel to the front surface 21*e*, and the other one fitting portion extends from the base end 24 to be parallel to the right side surface 21*d*.

Figure 21A:
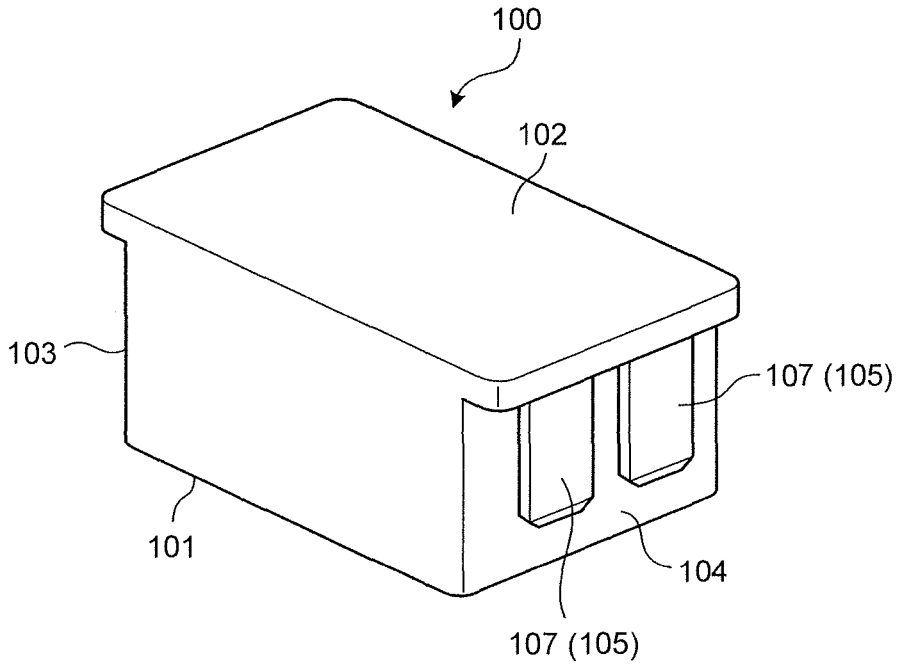
FIG. 21A is a perspective view illustrating an appearance of a relay in which base ends of lead terminals are surrounded with a resin.

In the above-mentioned relays, all the base ends of the lead terminals are completely exposed, but at least parts of the base ends may be covered with a resin. FIG. 21A is a perspective view illustrating appearance of a relay in which the base ends of the lead terminals are covered with a resin and FIG. 21B is a side view of the relay illustrated in FIG. 21A.

Figure 21B:
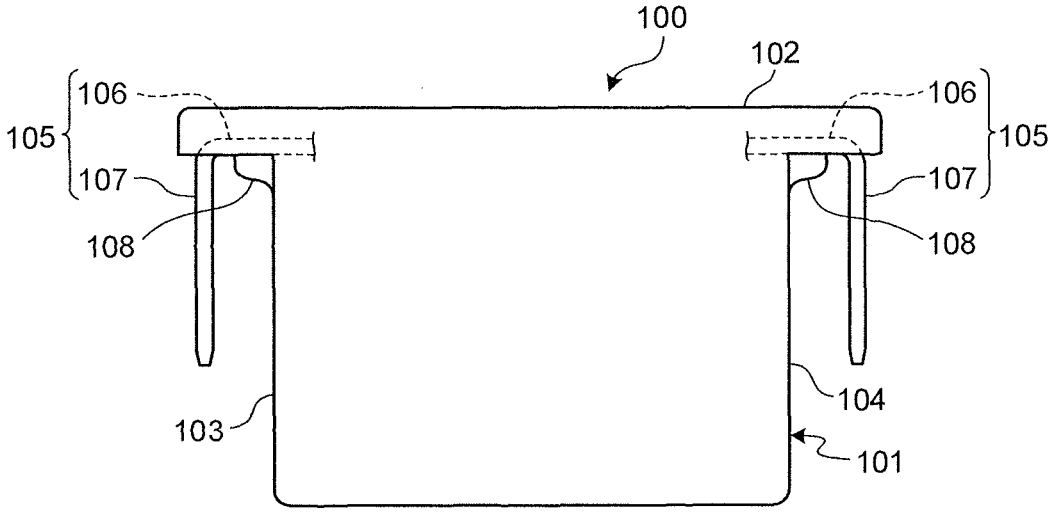
FIG. 21B is a side view of the relay illustrated in FIG. 21A.

As illustrated in FIGS. 21A and 21B, a plate-like insulating member 102 is attached to a relay 100 along one surface (for example, the surface corresponding to the top surface 21*a* in the embodiments) of a relay main body 101. The insulating member 102 is formed in a substantially rectangular shape in a plan view by molding an insulating resin or the like. The insulating member 102 extends in a direction perpendicular to a pair of side surfaces 103 and 104 of the relay main body 101 which are disposed to face each other. Each of the side surfaces 103 and 104 is provided with two lead terminals 105. The lead terminals 105 are disposed such that contact portions 107 thereof face the side surfaces 103 and 104. The insulating member 102 is formed to cover base ends 106 of the lead terminals 105.

As illustrated in FIG. 21B, the base ends 106 of the lead terminals 105 are covered with the insulating member 102 in the axial direction thereof and the contact portions 107 of the lead terminals 105 are disposed to protrude from the bottom surface of the insulating member 102. Protrusions 108 are formed to have a level difference at positions at which the insulating member 102 and the side surfaces 103 and 104 intersect each other. The protrusions 108 come in contact with the top end face of the wall portion in assembling the relay 100 into the housing member. The base ends 106 of the lead terminals 105 may be disposed to protrude from the protrusions 108 or may be disposed to protrude from the side surfaces 103 and 104 of the relay main body 101.

According to this configuration, the base ends 106 of the lead terminals 105 can be supported from the upper side by the insulating member 102. Accordingly, since a load applied to the lead terminals 105 in inserting the lead terminals 105 into the terminal fittings can be greatly reduced, it is possible to prevent deformation of the lead terminals 105. As a result, it is possible to keep favorable electrical connection state between the lead terminals 105 and the terminal fittings and to prevent a decrease in the holding force of the relay 100 to the housing member. By covering the base ends 106 of the lead terminals 105 with the insulating member 102, it is possible to prevent a short circuit between neighboring lead terminals 105.

Accordingly, the fitting timing at which the terminal portion having a low rigidity is fitted to the terminal fitting can be made to delay behind the fitting timing of the terminal portion having a high rigidity. That is, when the terminal portion having a low rigidity is fitted to the terminal fitting, fitting of the terminal portion having a high rigidity to the terminal fitting is started and the electronic component has a proper insertion posture with respect to the housing member.

Accordingly, the fitting portion can be fitted to the terminal fitting in a state in which the terminal portion having a low rigidity is surely directed in the proper insertion direction. As a result, it is possible to protect the terminal portion having a low rigidity and to assemble the electronic component into the housing member while preventing the terminal portion having a low rigidity from being subjected to damage such as deformation at the time of fitting to the terminal fitting.

In order to make the fitting timing to delay in this way, it is necessary to adjust a relative positional relationship between the fitting portion of the terminal portion and the terminal fitting for each terminal portion. As adjustment means thereof, for example, among the plurality of terminal fittings, the terminal fitting to which the fitting portion of the terminal portion having a lower rigidity is fitted can be positioned on a deeper side in the fitting direction. In this case, by arranging the positions of the extending tips of the fitting portions of the terminal portions at the same height, it is possible to make the fitting timing of the terminal portion having a low rigidity to the terminal fitting delay behind the terminal portion having a high rigidity.

Alternatively, as another adjustment means, among the fitting portions of the plurality of terminal portions, the position of the extending tip of the fitting portion of the terminal portion having a lower rigidity may be positioned on a shallower side in the fitting direction. In this case, by arranging the positions of the terminal fittings to which the fitting portions of the terminal portions at the same height, it is possible to make the fitting timing of the terminal portion having a low rigidity to the terminal fitting delay behind the terminal portion having a high rigidity.

When an electrical junction box including the above-mentioned electronic component assembly structure is employed, it is possible to protect the terminal portion having a low rigidity of the electronic component in the electrical junction box and to assemble the electronic component into the housing member while preventing the terminal portion having a low rigidity from being subjected to damage such as deformation at the time of fitting to the terminal fitting.

According to the present invention, even when an electronic component in an electronic component module includes a plurality of terminal portions having different rigidities, it is possible to protect a terminal portion having a low rigidity in fitting the terminal portions to the terminal fittings.

While the embodiments of the present invention have been described in detail with reference to the drawings, the above-mentioned embodiments are only examples of the present invention and the present invention is not limited to the embodiments. Therefore, modifications in design or the like without departing from the gist of the present invention are included in the scope of the present invention.

What is claimed is:

1. An electronic component assembly structure comprising:

an electronic component;

a plurality of terminal fittings to which the electronic component is fitted; and a housing member in which the electronic component and the terminal fittings are received, wherein the electronic component includes a main body section having a rectangular parallelepiped shape; and a plurality of terminal portions having different rigidities, the housing member includes a first housing chamber configured to guide and receive the main body section therein; and a second housing chamber configured to receive and hold the terminal fittings therein, the first housing chamber is formed by surrounding four sides thereof with a frame-like wall portion rising upright from a bottom portion, and the second housing chamber is formed outside the wall portion interposed therebetween, each of the terminal portions includes a base end; and a fitting portion configured to extend from a protruding tip of the base end along a side surface of the main body section with a gap from the side surface and which is fitted to the corresponding terminal fitting, the fitting portions of the terminal portions and the terminal fittings are positioned such that a fitting timing of the fitting portion of the terminal portion having a relatively lower rigidity, among the plurality of terminal portions, to the terminal fitting is more delayed, and the electronic component, the terminal fittings, and the housing member are mutually assembled.

2. The electronic component assembly structure according to claim 1, wherein the terminal fitting to which the fitting portion of the terminal portion having a lower rigidity is fitted, among the plurality of terminal fittings, is positioned on a deep side in the fitting direction.

3. An electrical junction box comprising:

the electronic component assembly structure according to claim 2.

4. The electronic component assembly structure according to claim 1, wherein the position of the extending tip of the fitting portion of the terminal portion having a lower rigidity, among the fitting portions of the plurality of terminal portions, is positioned on a shallow side in the fitting direction.

5. An electrical junction box comprising:

the electronic component assembly structure according to claim 4.

6. An electrical junction box comprising:

the electronic component assembly structure according to claim 1.

* * * * *